US010843476B2

(12) United States Patent
Shirono et al.

(10) Patent No.: US 10,843,476 B2
(45) Date of Patent: Nov. 24, 2020

(54) METHOD OF MANUFACTURING A LIQUID CARTRIDGE AND A LIQUID CARTRIDGE FOR RECYCLING

(71) Applicants: Taichi Shirono, Nagoya (JP); Noritsugu Ito, Tokoname (JP)

(72) Inventors: Taichi Shirono, Nagoya (JP); Noritsugu Ito, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 327 days.

(21) Appl. No.: 15/799,291

(22) Filed: Oct. 31, 2017

(65) Prior Publication Data

US 2018/0056660 A1 Mar. 1, 2018

Related U.S. Application Data

(63) Continuation of application No. 14/040,708, filed on Sep. 29, 2013, now Pat. No. 9,821,564, which is a (Continued)

(30) Foreign Application Priority Data

Mar. 31, 2011 (JP) ..... 2011 -078031

(51) Int. Cl.
*B41J 2/175* (2006.01)
*B41J 2/16* (2006.01)

(52) U.S. Cl.
CPC ..... *B41J 2/17559* (2013.01); *B41J 2/1753* (2013.01); *B41J 2/17506* (2013.01); (Continued)

(58) Field of Classification Search
CPC ..... B41J 2/17559; B41J 2/17523; B41J 2/17553; B41J 2/1753; B41J 2/17546; B41J 2/17506; Y10T 29/49401
(Continued)

(56) References Cited

U.S. PATENT DOCUMENTS 5,400,573 A * 3/1995 Crystal ..... B41J 2/17506 141/18
5,515,663 A * 5/1996 Allgeier, Sr. ..... B41J 2/17506 347/87

(Continued)

FOREIGN PATENT DOCUMENTS

EP 0940258 A1 9/1999
EP 1570995 A1 9/2005

(Continued)

OTHER PUBLICATIONS

World Intellectual Property Office International Bureau, International Preliminary Report on Patentability for International Application No. PCT/JP2011/066600 (related to the above-captioned patent application), dated Oct. 10, 2013.

(Continued)

*Primary Examiner* — Peter Dungba Vo
*Assistant Examiner* — Kaying Kue
(74) *Attorney, Agent, or Firm* — Baker Botts L.L.P.

(57) ABSTRACT

A method for manufacturing a liquid cartridge for recycling includes a preparing step and a first step. The preparing step prepares the liquid cartridge for recycling. The liquid cartridge for recycling includes a liquid accommodating portion, a flowing path, a stopper, and a valve. The first step includes a first insertion step, a firs valve open step, a first injection step, a first valve close step, a first removal step, and a first mounting step. The first insertion step inserts an injection member into the stopper. The first injection step injects the liquid into the liquid accommodating portion through the injection member, after the first insertion step and the first valve open step. The first removal step removes the stopper from the opening while the valve is maintained in the closed position after the first valve close step. The first mounting step mounts a new stopper.

8 Claims, 19 Drawing Sheets

Related U.S. Application Data continuation-in-part of application No. PCT/JP2011/066600, filed on Jul. 21, 2011.

(52) U.S. Cl.
CPC ..... *B41J 2/17523* (2013.01); *B41J 2/17546* (2013.01); *B41J 2/17553* (2013.01); *Y10T 29/49401* (2015.01)

(58) Field of Classification Search
USPC ... 29/890.1, 402.03, 402.04, 402.08, 402.02, 29/890.09
See application file for complete search history.

(56) References Cited

U.S. PATENT DOCUMENTS

| | | | | |
|---|---|---|---|---|
| 5,706,870 | A * | 1/1998 | Maerzke | B41J 2/17506 141/18 |
| 5,732,751 | A * | 3/1998 | Schmidt | B41J 2/17506 141/2 |
| 5,777,646 | A | 7/1998 | Barinaga et al. | |
| 5,802,818 | A * | 9/1998 | Doll | B41J 2/17506 347/85 |
| 5,845,682 | A * | 12/1998 | Hayao | B41J 2/17506 141/18 |
| 6,036,305 | A * | 3/2000 | Nagasaki | B41J 2/17513 347/86 |
| 6,058,984 | A * | 5/2000 | Sato | B41J 2/17506 141/13 |
| 6,158,851 | A | 12/2000 | Zepeda | |
| 6,332,481 | B1 * | 12/2001 | Shinada | B41J 2/17506 141/18 |
| 6,539,985 | B2 * | 4/2003 | Shinada | B41J 2/17523 141/2 |
| 6,905,199 | B2 * | 6/2005 | Miyazawa | B41J 2/17503 347/86 |
| 7,018,026 | B2 * | 3/2006 | Yamada | B41J 2/17523 347/85 |
| 7,393,088 | B2 * | 7/2008 | Sasaki | B41J 2/17523 347/84 |
| 7,618,137 | B2 * | 11/2009 | Inoue | B41J 2/1752 347/86 |
| 7,658,480 | B2 * | 2/2010 | Uehara | B41J 2/17513 347/85 |
| 8,147,046 | B2 | 4/2012 | Yamashita | |
| 8,286,669 | B2 * | 10/2012 | Yoneda | B41J 2/17559 141/2 |
| 8,613,488 | B2 * | 12/2013 | Tomoguchi | B41J 2/1752 347/7 |
| 8,851,644 | B2 * | 10/2014 | Shirono | B41J 2/17546 347/86 |
| 9,132,655 | B2 * | 9/2015 | Ito | B41J 2/17523 |
| 2007/0070138 | A1 | 3/2007 | Hattori et al. | |
| 2009/0262171 | A1 | 10/2009 | Yamashita | |
| 2009/0322838 | A1 * | 12/2009 | Wanibe | B41J 2/17506 347/86 |

FOREIGN PATENT DOCUMENTS

| | | | |
|---|---|---|---|
| GB | 2288148 | A | 10/1995 |
| JP | H08-300673 | A | 11/1996 |
| JP | H09-174876 | A | 7/1997 |
| JP | 2002-505212 | A | 2/2002 |
| JP | 2006-159835 | A | 6/2006 |
| JP | 2006-315419 | A | 11/2006 |
| JP | 2008-307871 | A | 12/2008 |
| JP | 2009-061785 | A | 3/2009 |
| WO | 99/44830 | A1 | 9/1999 |

OTHER PUBLICATIONS

European Patent Office, Extended European Search Report issued for Patent Application No. 11862466.7 dated Mar. 19, 2015.

* cited by examiner

FIG. 15A1
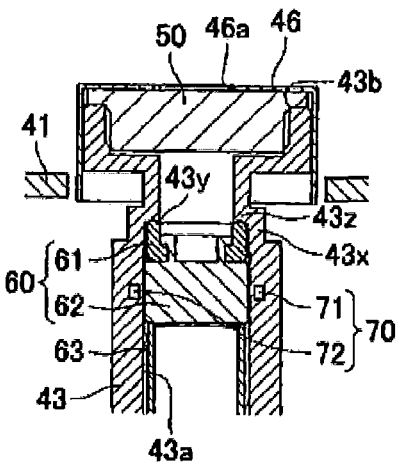
FIG. 15A2
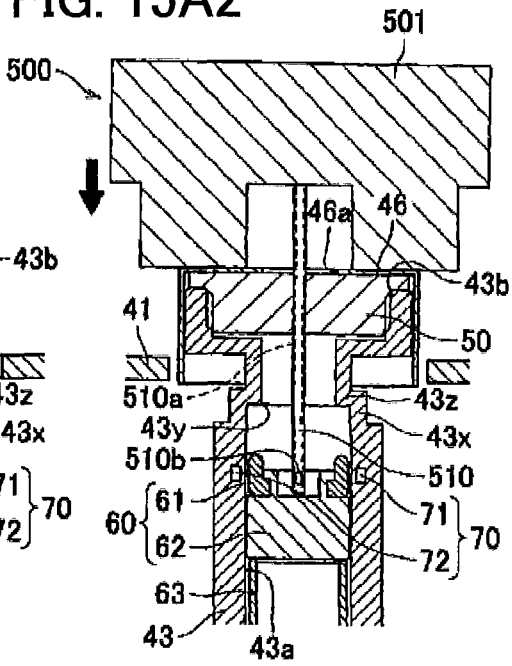
FIG. 15B1
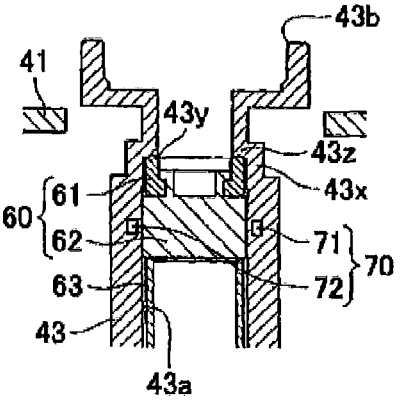
FIG. 15B2
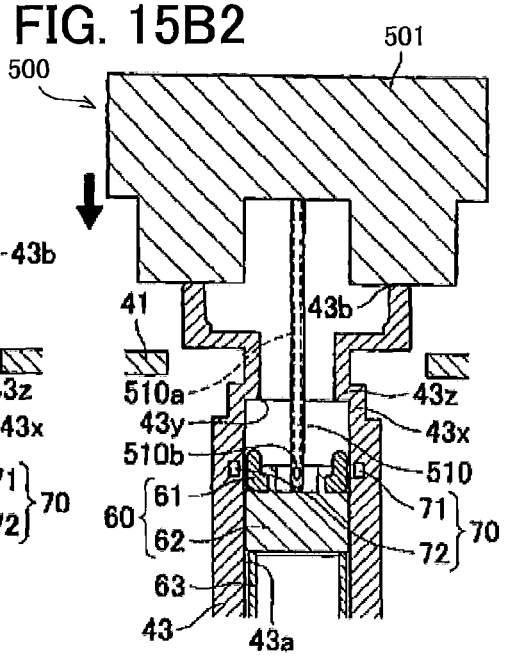

METHOD OF MANUFACTURING A LIQUID CARTRIDGE AND A LIQUID CARTRIDGE FOR RECYCLING

CROSS REFERENCE TO RELATED APPLICATION

The present application is a continuation of U.S. patent application Ser. No. 14/040,708 filed on Sep. 29, 2013, which is a continuation in part of International Application No. PCT/JP2011/066600 filed Jul. 21, 2011, which claims priority from Japanese Patent Application No. 2011-078031 filed Mar. 31, 2011, the disclosures of which are incorporated herein by reference in their entirety.

TECHNICAL FIELD

The present invention relates to a method of manufacturing a liquid cartridge and a liquid cartridge for recycling.

BACKGROUND

Technologies related to liquid cartridges are well known in the art. One example of a liquid cartridge described in the prior art has a channel in fluid communication with a liquid-accommodating section, a spherical body disposed in this channel, and the like. The spherical body can be moved between a closed position in which the spherical body contacts a wall provided in the channel for closing the channel, and an open position in which the spherical body is separated from the wall.

In another example of a liquid cartridge disclosed in the art, an injection tube is inserted into the channel in fluid communication with a liquid-accommodating section in order to injection liquid from a replenishing tank into the liquid-accommodating section.

SUMMARY OF THE INVENTION

However, in the conventional liquid cartridges described above, the liquid can leak out of the cartridge, either when liquid is being injected into the liquid-accommodating section or after the liquid has been injected.

In view of the foregoing, it is an object of the present invention to provide a method of manufacturing a liquid cartridge and method of recycling a liquid cartridge capable of effectively suppressing ink leakage.

In order to attain above and other objects, the present invention provides a method for manufacturing a liquid cartridge for recycling. The method includes a preparing step and a first step. The preparing step prepares the liquid cartridge for recycling. The liquid cartridge for recycling includes a liquid accommodating portion, a flowing path, a stopper, and a valve. The liquid accommodating portion is configured to accommodate therein a liquid. The flowing path has one end in fluid communication with the liquid accommodating portion and another end formed with an opening. The stopper has an elasticity and is configured to be mounted to the opening for covering the opening. The valve is configured to selectively move in the flowing path between an open position to open the flowing path and a closed position to close the flowing path. The first step includes a first insertion step, a first valve open step, a first injection step, a first valve close step, a first removal step, and a first mounting step. The first insertion step inserts an injection member into the stopper mounted to the opening. The first valve open step moves the valve to the open position. The first injection step injects the liquid into the liquid accommodating portion through the injection member while the injection member is inserted into the stopper and the valve is maintained in the open position, after the first insertion step and the first valve open step. The first valve close step moves the valve to the closed position after the first injection step. The first removal step removes the stopper from the opening while the valve is maintained in the closed position after the first valve close step. The first mounting step mounts a new stopper different from the stopper removed in the first removal step to the opening while the valve is maintained in the closed position after the first removal step.

According to another aspect, the present invention provides a method for manufacturing a liquid cartridge. The method includes a preparing step, a valve open step, an injection step, a valve close step, and a mounting step. The preparing step prepares the liquid cartridge. The liquid cartridge includes a liquid accommodating portion, a flowing path, and a valve. The liquid accommodating portion is configured to accommodate therein a liquid. The flowing path has one end in fluid communication with the liquid accommodating portion and another end formed with an opening. The valve is configured to selectively move in the flowing path between an open position to open the flowing path and a closed position to close the flowing path. The valve open step provides a contact between an injection member and the valve to move the valve to the open position. The injection step injects the liquid into the liquid accommodating portion through the injection member while the valve is maintained in the open position, after the valve open step. The valve close step moves the injection member to shift the valve to the closed position after the injection step. The mounting step mounts a stopper having an elasticity for covering the opening while the valve is maintained in the closed position after the valve close step.

BRIEF DESCRIPTION OF THE DRAWINGS

In the drawings;

FIG. 15A1 is a partial cross-sectional view of the region VI shown in FIG. 4 when a stopper is mounted to the ink cartridge;

FIG. 15A2 is a partial cross-sectional view of the region VI shown in FIG. 4 when an injector is activated while the stopper is mounted to the ink cartridge;

FIG. 15B1 is a partial cross-sectional view of the region VI shown in FIG. 4 when the stopper is removed from the ink cartridge;

FIG. 15B2 is a partial cross-sectional view of the region VI shown in FIG. 4 when then injector is activated while the stopper is removed from the ink cartridge;

DESCRIPTION OF THE PREFERRED EMBODIMENTS

Next, preferred embodiments of the present invention will be described while referring to the accompanying drawings. The liquid cartridge according to the present invention will be described according to a first embodiment. In the first embodiment, the liquid cartridge according to the present invention is an ink cartridge 40 detachably mounted in a printer 1 shown in FIG. 1. The external structure of the printer 1 will be described next.

Figure 1:
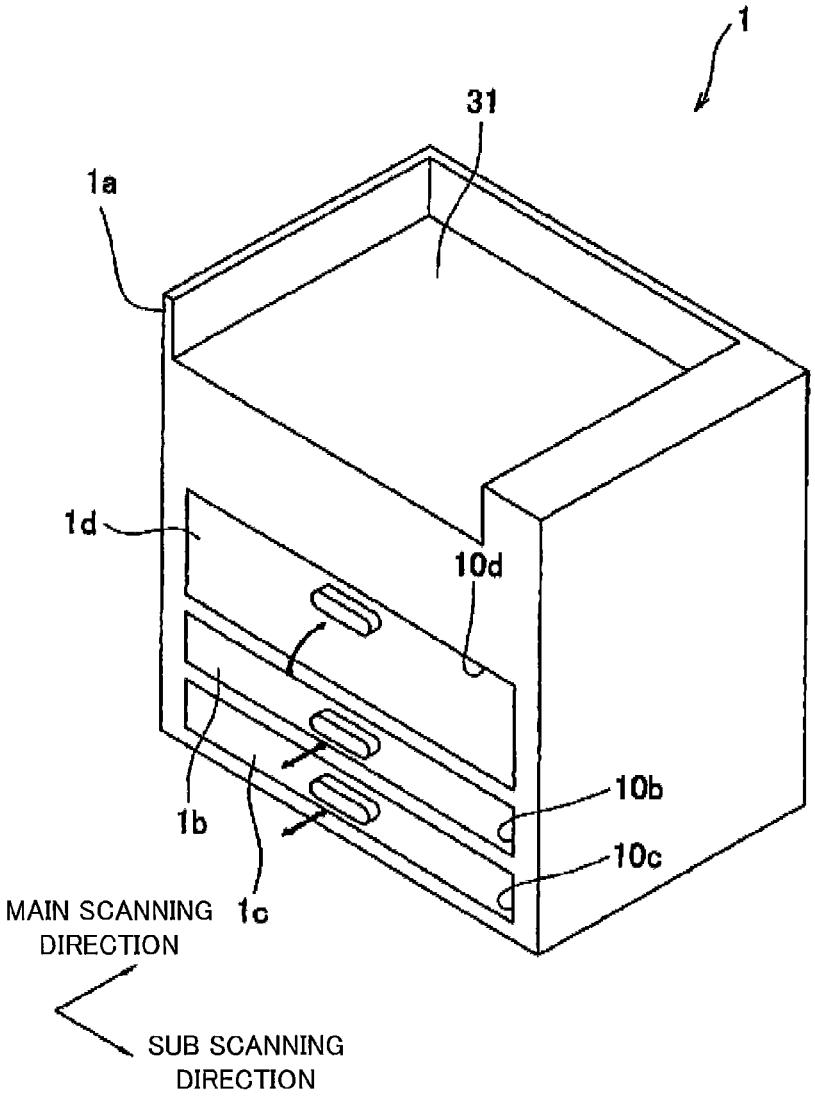
FIG. 1 is an external schematic perspective view of an inkjet-type printer capable of receiving an ink cartridge according to a first embodiment of the present invention.

As shown in FIG. 1, the printer 1 has a main casing 1*a*. The casing 1*a* has a rectangular parallelepiped shape. The casing 1*a* has a top portion formed with a discharge unit 31. Three openings 10*d*, 10*b*, and 10*c* are formed in order from top to bottom on the front surface of the casing 1*a* (the surface on the near left side in FIG. 1).

The opening 10*b* is provided for inserting a sheet-feeding unit 1*b* into the casing 1*a*, while the opening 10*c* is formed for inserting an ink unit 1*c* into the casing 1*a*. A door 1*d* is fitted into the opening 10*d* and is pivotally movable about a horizontal axis passing through the lower edge thereof. The door 1*d* is provided in the casing 1*a* at a position confronting a conveying unit 21 described later (see FIG. 2) in a main scanning direction of the inkjet printer 1 (a direction orthogonal to the front surface of the casing 1*a*).

Next, the internal structure of the inkjet printer 1 will be described with reference to FIG. 2.

The interior of the casing 1*a* is partitioned into three spaces A, B, and C in order from top to bottom. Within the space A are disposed four inkjet heads 2 for ejecting ink droplets in the respective colors magenta, cyan, yellow, and black; a conveying unit 21 for conveying sheets of a paper P; and a controller 100 for controlling operations of various components in the inkjet printer 1. The sheet-feeding unit 1*b* is disposed in the space B, and the ink unit 1*c* is disposed in the space C. As indicated by the bold arrows in FIG. 2, the inkjet printer 1 is formed with a paper-conveying path for guiding sheets of paper P conveyed from the sheet-feeding unit 1*b* to the discharge unit 31.

The controller 100 includes a central processing unit (CPU), a read-only memory (ROM), a random access memory (RAM; including nonvolatile RAM), and an interface. The ROM stores programs executed by the CPU, various fixed data, and the like. The RAM temporarily stores data (image data and the like) required by the CPU when executing programs. Through the interface, the controller 100 receives data from a memory unit 141 of an ink cartridge 40 described later, exchanges data with a sensor unit 70 of the ink cartridge 40 described later, exchanges data with external devices such as a PC connected to the inkjet printer 1, and the like.

The sheet-feeding unit 1*b* includes a paper tray 23, and a feeding roller 25. The paper tray 23 can be mounted in and removed from the casing 1*a* along the main scanning direction. The paper tray 23 has a box shape with its top open and serves to accommodate sheets of paper P in a variety of sizes. The feeding roller 25 is driven to rotate by a feeding motor 125 (see FIG. 8) under control of the controller 100 in order to feed the topmost sheet of paper P in the paper tray 23. A sheet fed by the feeding roller 25 is guided along guides 27*a* and 27*b*, and a pair of conveying rollers 26 grip and convey the sheet to the conveying unit 21.

The conveying unit 21 includes two belt rollers 6 and 7 and an endless conveying belt 8 looped around the belt rollers 6 and 7 so as to be in a taut state. The belt roller 7 is the drive roller. A conveying motor 127 (see FIG. 8) coupled with a shaft of the belt roller 7 drives the belt roller 7 to rotate clockwise in FIG. 2 under control of the controller 100. The belt roller 6 is a follow roller that rotates clockwise in FIG. 2 when the conveying belt 8 is circulated by the rotation of the belt roller 7.

The conveying belt 8 forms the loop in which a platen 19 having a rectangular parallelepiped shape is disposed at a position opposite the four inkjet heads 2. The conveying belt 8 defines an outer surface 8*a* whose upper loop portion is supported by the platen 19 and extends parallel to the bottom surface 2*a* of the four inkjet heads 2 with a slight gap formed between the bottom surfaces 2*a* and the outer surface 8*a*. The bottom surfaces 2*a* of the inkjet heads 2 are ejection surfaces formed with a plurality of ejection holes for ejecting ink droplets.

The outer surface 8*a* of the conveying belt 8 is coated with mildly adhesive silicon. When a sheet of paper P is conveyed from the sheet-feeding unit 1*b* onto the conveying unit 21, a pinch roller 4 disposed above the belt roller 6 holds the sheet against the outer surface 8*a* of the conveying belt 8. Thereafter, the conveying belt 8 conveys the sheet in a sub scanning direction indicated by the bold arrows, while the sheet is held on the outer surface 8*a* by its adhesive coating.

The sub scanning direction in the preferred embodiment is equivalent to the direction that the conveying unit 21 conveys the paper P. The main scanning direction is orthogonal to the sub scanning direction and extends horizontally.

As the sheet of paper P held on the outer surface 8*a* of the conveying belt 8 passes directly beneath the four inkjet heads 2, the controller 100 sequentially controls the inkjet heads 2 to eject ink droplets in their respective colors through their bottom surfaces 2*a* onto the top surface of the paper P, thereby forming a desired color image on the paper P. A separating plate 5 disposed above the belt roller 7 separates the sheet from the outer surface 8*a* of the conveying belt 8 after the sheet has passed beneath the inkjet heads 2. Guides 29*a* and 29*b* disposed downstream of the separating plate 5 guide the sheet upward toward an opening 30 formed in the top of the casing 1*a*, while two pairs of conveying rollers 28 grip and convey the sheet toward and through the opening 30 and discharge the sheet onto the discharge unit 31. A feeding motor 128 (see FIG. 8) controlled by the controller 100 drives one of the conveying rollers 28 in each pair to rotate.

Each of the inkjet heads 2 is a line-type print head elongated in the main scanning direction (the direction orthogonal to the plane of the paper in FIG. 1). Externally, the inkjet head 2 is shaped substantially like a rectangular parallelepiped. The four inkjet heads 2 are arranged at prescribed intervals in the sub scanning direction and are supported in the casing 1*a* on a frame 3. A joint is provided on the top surface of each inkjet head 2 for attaching a flexible tube. The bottom surface 2*a* of each inkjet head 2A is formed with a plurality of ejection holes for ejecting ink droplet. Ink cartridges 40 provided one for each of the inkjet heads 2 supply ink to the corresponding inkjet heads 2 through the flexible tubes and joints. An ink channel is formed in each inkjet head 2 for conveying the ink supplied from the ink cartridge 40 to the ejection holes.

The ink unit 1*c* includes a cartridge tray 35, and four of the ink cartridges 40 juxtaposed within the cartridge tray 35. The leftmost ink cartridge 40 shown in FIG. 2 stores black ink. The leftmost ink cartridge 40 has a larger dimension in the sub scanning direction and, hence, a greater ink capacity than the other three ink cartridges 40. The remaining ink cartridges 40 have an identical dimension in the sub scanning direction and an identical ink capacity among one another. These three ink cartridges 40 respectively store ink in the colors magenta, cyan, and yellow. Ink stored in each of the ink cartridges 40 is supplied to the corresponding inkjet head 2 via a flexible tube and joint.

With the ink cartridges 40 arranged in the cartridge tray 35, the cartridge tray 35 can be mounted in and removed from the casing 1*a* along the main scanning direction. Accordingly, a user of the inkjet printer 1 can selectively replace the four ink cartridges 40 in the cartridge tray 35 after removing the cartridge tray 35 from the casing 1*a*.

Figure 7A:
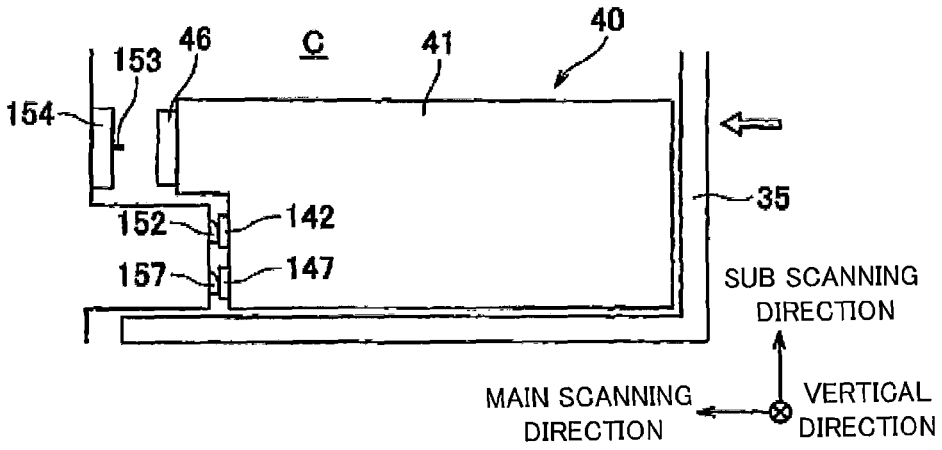
FIG. 7A is a schematic plain view illustrating a process for mounting the ink cartridge in the printer when the ink cartridge is electrically connected to the printer.
Figure 7B:
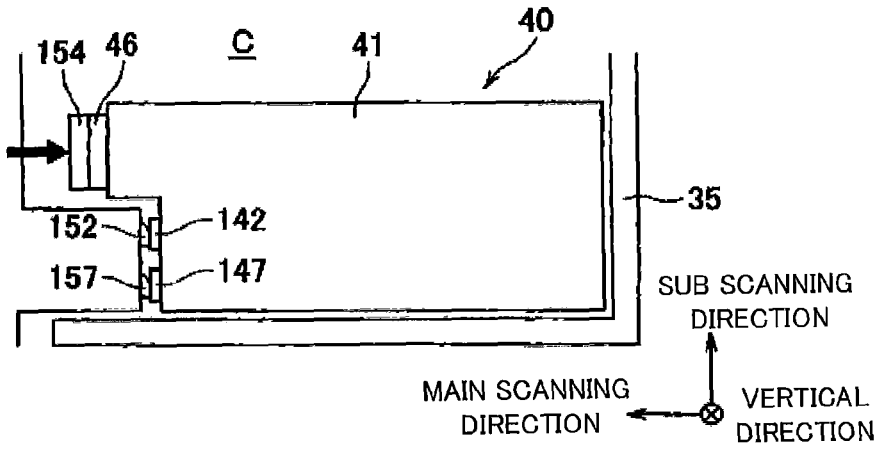
FIG. 7B is a schematic plain view illustrating the process for mounting the ink cartridge in the printer when a hollow needle is inserted into a channel.
Figure 8:
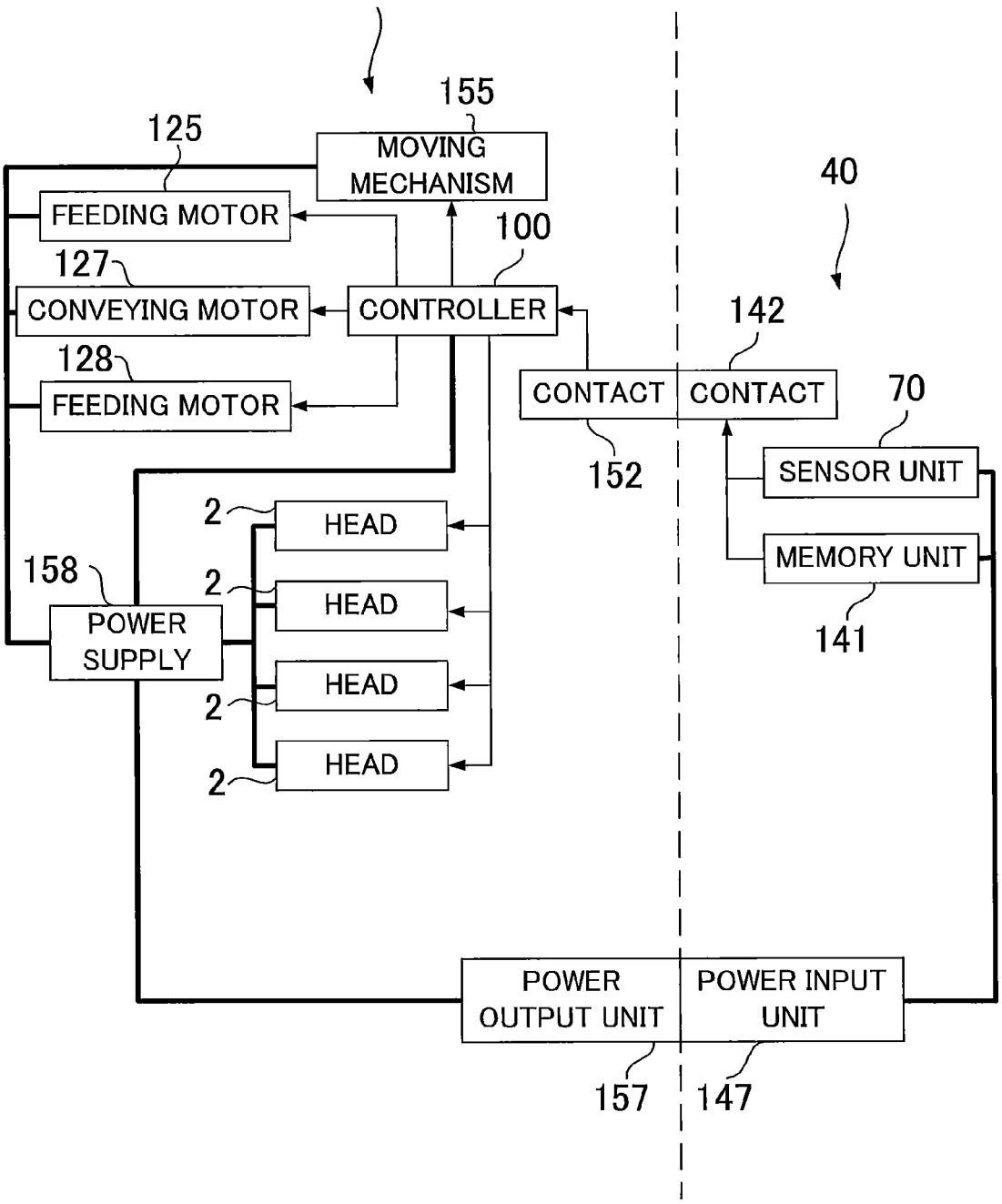
FIG. 8 is a schematic block diagram illustrating an electrical structure of the printer and the ink cartridge.

As shown in FIGS. 7 and 8, the printer 1 is also provided with contacts 152, hollow needles 153, support bodies 154, a moving mechanism 155, power output units 157, and a power supply 158.

The contacts 152 are formed on a wall surface of the casing 1*a* that defines space C. The contacts 152 are electrically connected to the controller 100 and function as interfaces of the controller 100 for relaying signals from the controller 100 to the ink cartridges 40.

The hollow needles 153 are fixed to the support bodies 154 and are in communication with the flexible tubes attached to the joints of the corresponding inkjet heads 2. Each hollow needle 153 is formed with a channel 153*a* extending in its longitudinal dimension. The channel 153*a* is connected to and in fluid communication with the corresponding flexible tube. The hollow needle 153 is formed with a hole 153*b* near the distal end thereof for providing external communication with the channel 153*a* as shown in FIGS. 6B and 6D. One each of the contacts 152 and hollow needles 153 is provided for each ink cartridge 40.

The support bodies 154 are provided in the casing 1*a* at positions corresponding to caps 46 of the ink cartridges 40 described later. The support bodies 154 are capable of moving in the main scanning direction relative to the casing 1*a*.

The moving mechanism 155 is disposed in the casing 1*a* and functions to move the support bodies 154 in the main scanning direction.

The power output units 157 are disposed in a wall of the casing 1*a* defining space C at positions corresponding to power input units 147 of the ink cartridges 40 described later (see FIG. 7). The power output units 157 are electrically connected to the power supply 158.

The power supply 158 is disposed in the casing 1*a* and supplies power to various components of the printer 1.

Next, the structure of the ink cartridges 40 will be described with reference to FIGS. 3 through 6, and 8. The four ink cartridges 40 arranged in the cartridge tray 35 have an identical structure, except that the ink cartridge 40 accommodating black ink has a larger dimension in the sub scanning direction and a greater ink storage capacity than the ink cartridges 40 accommodating ink in the other colors, as described above.

Each ink cartridge 40 includes a case 41, a reservoir 42, a feed tube 43, a stopper 50, a valve 60, a sensor unit 70, a memory unit 141, a contact 142, and a power input unit 147.

Figure 3:
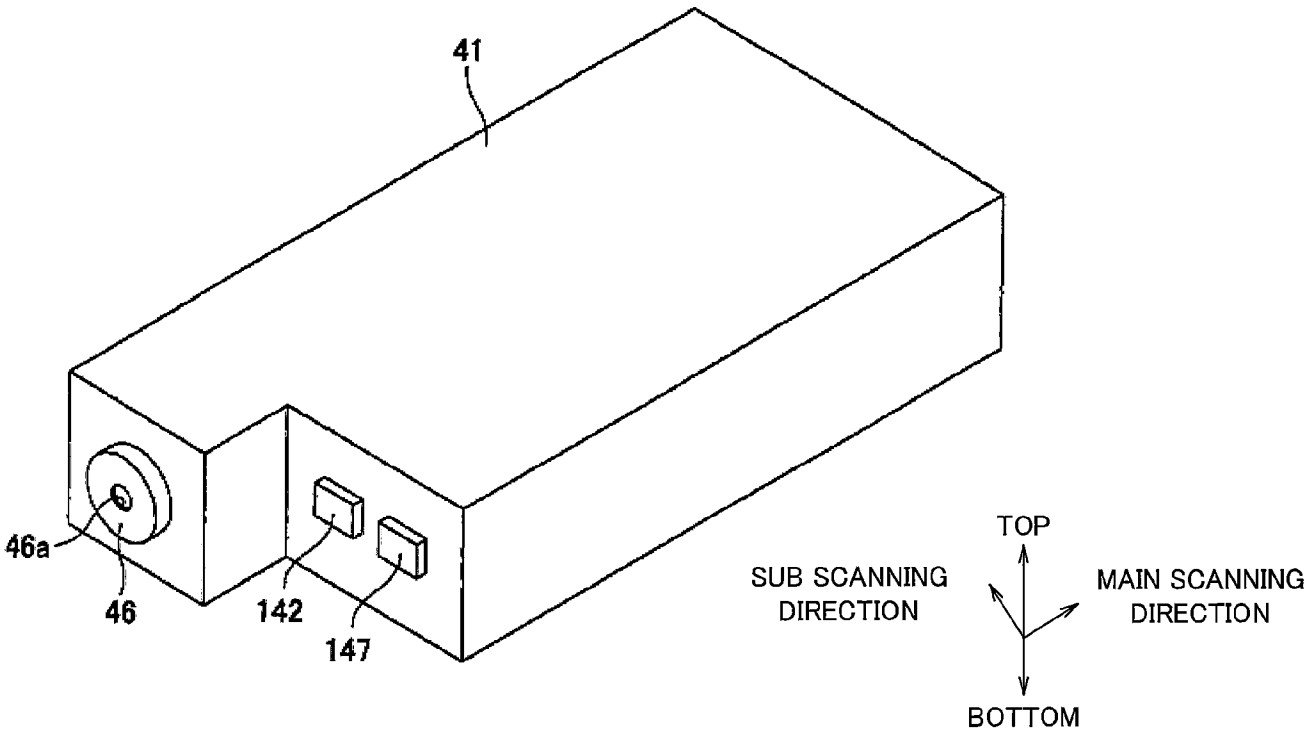
FIG. 3 is a perspective view of the ink cartridge.
Figure 4:
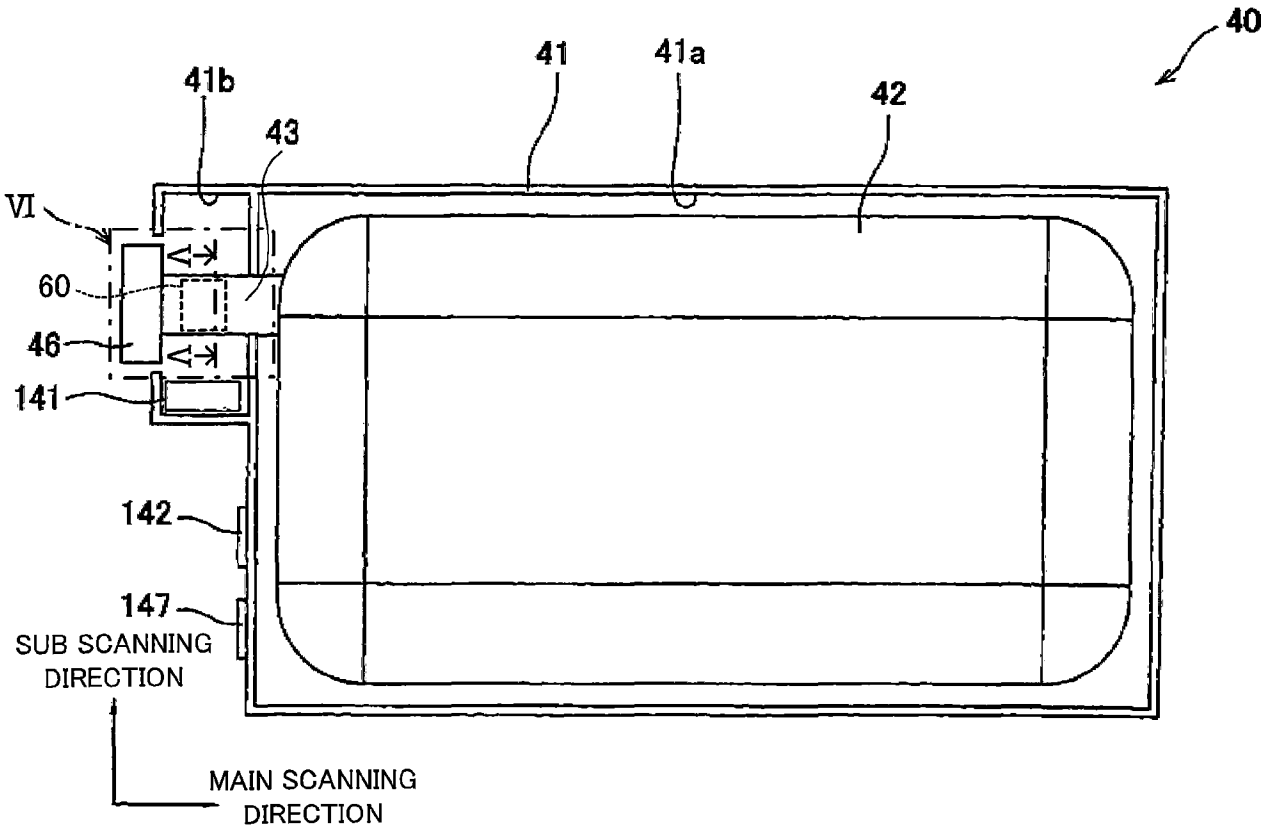
FIG. 4 is a schematic view of an internal structure of the ink cartridge.

As shown in FIG. 3, the case 41 has a rectangular parallelepiped shape. As shown in FIG. 4, the interior of the case 41 is partitioned into two chambers 41*a* and 41*b*. The reservoir 42 is provided in the chamber 41*a* constituting the large portion of the case 41 on the right side in FIG. 4, while the feed tube 43 and the memory unit 141 are provided in the other chamber 41*b*.

The reservoir 42 is a bag-like member disposed in the case 41 for accommodating ink. The reservoir 42 has an opening formed therein for connecting the base end of the feed tube 43.

The inner walls of the feed tube 43 define a supply path 43*a* for supplying ink accommodated in the reservoir 42 to the corresponding inkjet head 2. The feed tube 43 has a diameter-restricting part 43*x*. An opening 43*b* is formed in one end of the feed tube 43. A valve seat 43*z* that protrudes inward in a radial direction of the feed tube 43 from one end of the diameter-restricting part 43*x* (the end nearest the opening 43*b*). An opening 43*y* is defined as the end of the diameter-restricting part 43*x* near the valve seat 43*z*.

As shown in FIG. 4, the distal end of the feed tube 43 protrudes outside of the case 41. The stopper 50 is formed of a rubber or other elastic member and is fitted into this distal end of the feed tube 43 in a compressed state so as to block the opening 43*b* on the opposite end of the supply path 43*a* from the reservoir 42 (see FIGS. 6A-6D). A cap 46 is provided around the distal end of the feed tube 43 and the stopper 50. A hole 46*a* is formed in the center of the cap 46 so as to expose the center portion on the outer surface of the stopper 50 (the side surface of the stopper 50 opposite the inside surface that opposes the valve 60). As shown in FIGS.

4, 5, and 6A-6D, the valve 60 is provided inside the supply path 43*a* and includes an O-ring 61, and a valve body 62.

Figure 5:
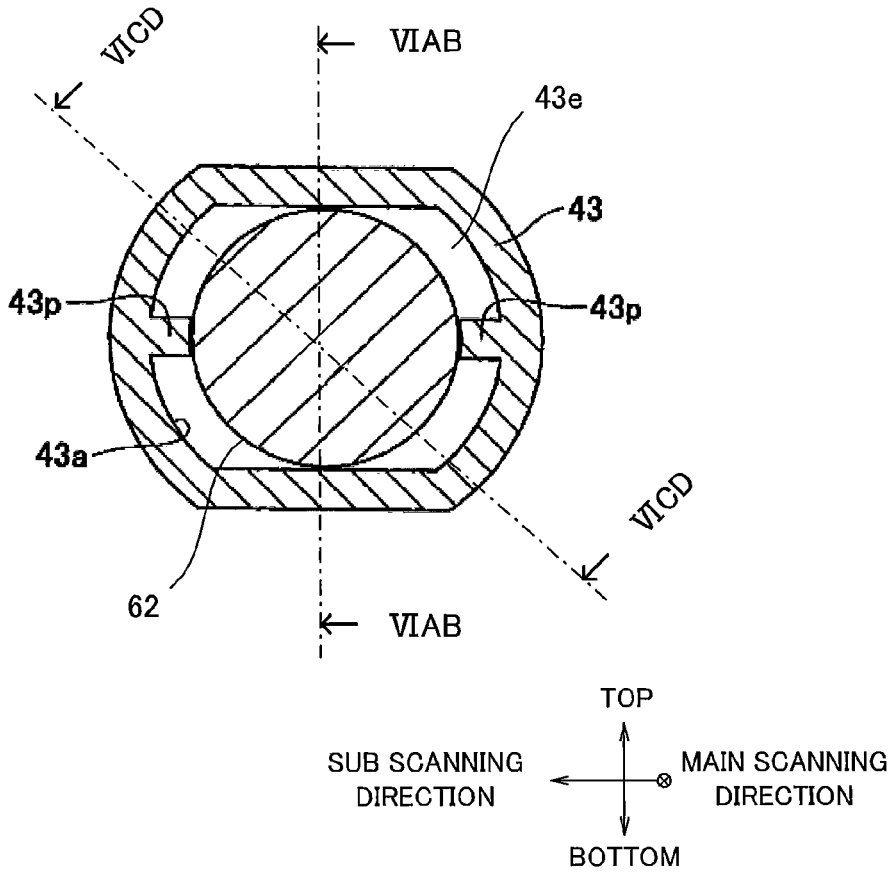
FIG. 5 is a partial cross-sectional view of the ink cartridge taken along a line V-V in a region VI of FIG. 4.

The valve body 62 is formed of a magnetic material in the form of a circular column having its axis aligned in the main scanning direction, as illustrated in FIGS. 5 and 6A-6D. As shown in FIG. 5, the portion of the feed tube 43 in which the valve body 62 is disposed is cylindrical in shape, with flattened top and bottom walls. A cross section of the feed tube 43 taken orthogonal to the main scanning direction is elongated in the sub scanning direction. The feed tube 43 has inner side walls each provided with a protrusion 43*p* with respect to the sub scanning direction protruding inward in the sub scanning direction. Each protrusion 43*p* extends in the main scanning direction along the side wall over a range in which the valve body 62 is movable. The valve body 62 is positioned in the center of the supply path 43*a* in a cross-sectional view and is held between the protrusions 43*p* and the upper and lower walls of the feed tube 43. With this construction, a channel 43*e* is defined between the valve body 62 and the feed tube 43, excluding regions in which the valve body 62 contacts the protrusions 43*p* and upper and lower walls of the feed tube 43.

The O-ring 61 is formed of a rubber or other elastic material and is fixed to the front surface (the surface opposing the stopper 50) of the valve body 62.

The valve 60 is urged toward the opening 43*y* by a coil spring 63. One end of the coil spring 63 is fixed to an anchoring part 43*f* that protrudes inward at the base end of the feed tube 43, while the other end of the coil spring 63 contacts the back surface of the valve body 62.

With this construction, the coil spring 63 constantly urges the O-ring 61 toward the stopper 50. When the valve 60 is in the position shown in FIGS. 6A and 6C (closed position), the O-ring 61 contacts the valve seat 43*z* and seals the opening 43*y*. In this case, the O-ring 61 interrupts external communication with the channel 43*e*, as illustrated in FIG. 6C. Note that the O-ring 61 is elastically deformed at this time by the urging force of the coil spring 63. On the other hand, contact between the valve 60 and the valve seat 43*z* is broken when the valve 60 is in the position shown in FIGS. 6B and 6D (open position). In this case, external communication with the channel 43*e* is allowed, as shown in FIGS. 6B and 6D.

The sensor unit 70 includes a Hall element 71, and a magnet 72. The magnet 72 serves to produce a magnetic field. The Hall element 71 is a magnetic sensor that converts an inputted magnetic field to an electric signal and outputs this electric signal to the controller 100 via the contact 142. In the preferred embodiment, the electric signal that the Hall element 71 outputs to the controller 100 specifies a voltage proportional to the magnitude of the magnetic field that varies in accordance with the movement of the valve body 62. The Hall element 71 is disposed at a position for detecting the magnetic field produced by the magnet 72 and the valve body 62 (see FIG. 6A).

Figure 6A:
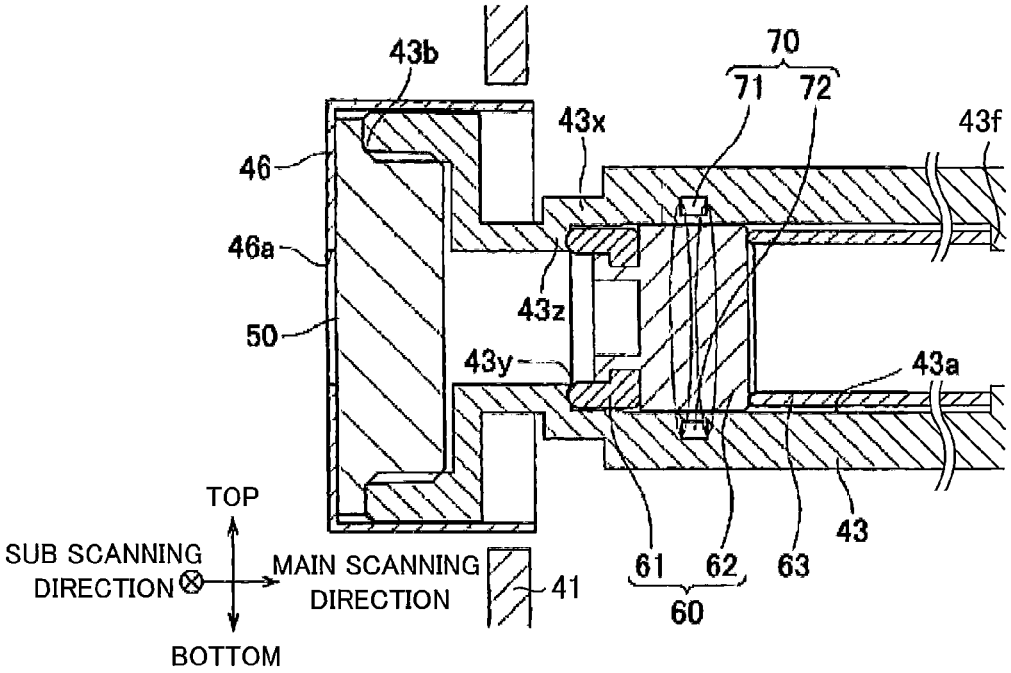
FIG. 6A is a partial cross-sectional view of the ink cartridge take along a line VIAB-VIAB in the region VI when a valve is in a closed position.
Figure 6B:
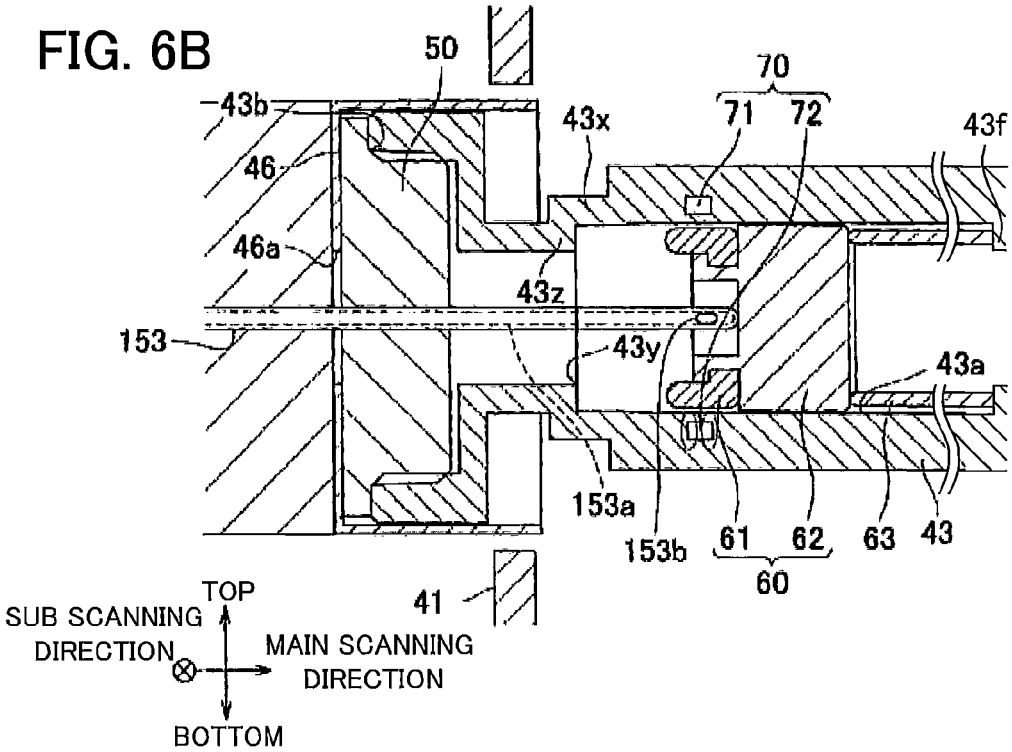
FIG. 6B is a partial cross-sectional view of the ink cartridge take along a line VIAB-VIAB in the region VI when a valve is in an open position.
Figure 6C:
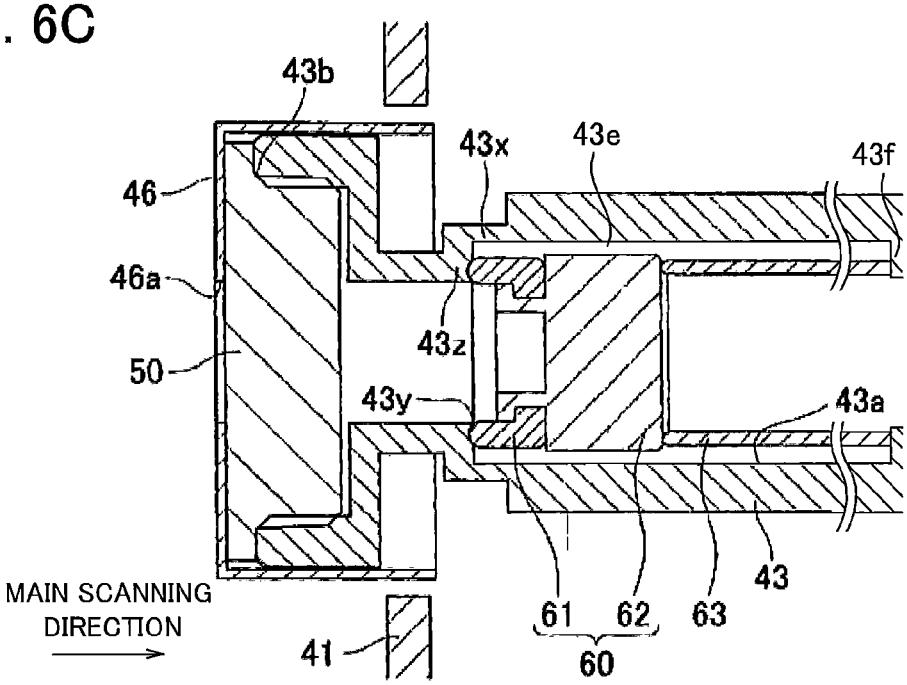
FIG. 6C is a partial cross-sectional view of the ink cartridge take along a line VICD-VICD in the region VI when a valve is in the closed position.
Figure 6D:
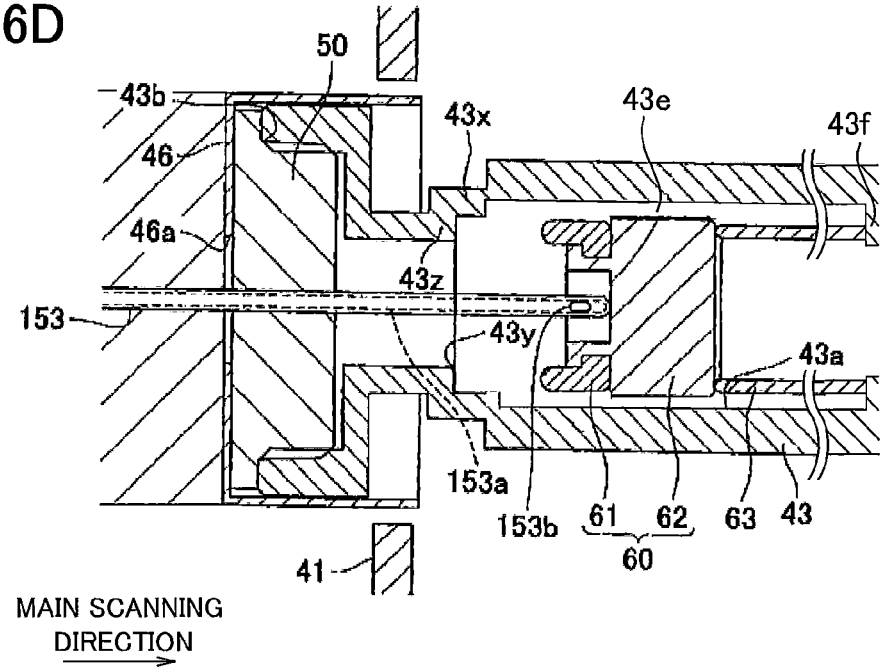
FIG. 6D is a partial cross-sectional view of the ink cartridge take along a line VICD-VICD in the region VI when a valve is in the open position.

As shown in FIG. 6A, the Hall element 71 and the magnet 72 are respectively disposed in the upper and lower walls of the outlet tube 43 and oppose each other vertically. When the valve 60 is in the closed position shown in FIG. 6A, the Hall element 71 is in confrontation with the magnet 72 with respect to the valve body 62 (i.e., the valve body 62 is positioned between the Hall element 71 and the magnet 72). At this time, the magnetic field produced by the magnet 72 is efficiently applied to the Hall element 71 through the valve body 62. Consequently, the Hall element 71 detects a large magnetic field and outputs a signal specifying a high voltage.

When the valve 60 is shifted from the closed position shown in FIG. 6A to the open position shown in FIG. 6B for opening the supply path 43*a*, the magnetic field detected by the Hall element 71 decreases as the valve body 62 moves toward a position offset from the Hall element 71 and the magnet 72 vertically (i.e., a position not between the Hall element 71 and the magnet 72), reducing the voltage indicated by the signal outputted from the Hall element 71. The controller 100 determines whether the valve 60 is in the open position or the closed position based on the voltage specified by the signal received from the Hall element 71.

The memory unit 141 is configured of EEPROM or the like and functions to store reference data for determining whether the stopper 50 has reached the end of its service life. This reference data may include data related to the number of times that the hollow needle 153 has been inserted through the stopper 50, or data related to the amount of time elapsed since the stopper 50 was manufactured. In the preferred embodiment, the reference data is data provided at the time the stopper 50 was manufactured, such as the manufactured date and time, and hereinafter will be called the "factory-set data."

Next, the operations for mounting the ink cartridge 40 in the printer 1 will be described with reference to FIGS. 6 through 10. In FIG. 8, the bold lines indicate power supply lines, while the fine lines indicate signal lines.

Before an ink cartridge 40 is mounted in the inkjet printer 1, the valve 60 is maintained in the closed position shown in FIG. 6A, since the hollow needle 153 has not yet been inserted into the stopper 50. At this stage, the electrical connections shown in FIG. 8 have not yet been established between the contact 142 and the contact 152 and between the power input unit 147 and the power output unit 157. Hence, the ink cartridge 40 and the inkjet printer 1 cannot exchange signals, and power is not being supplied to the sensor unit 70 and the memory unit 141.

To mount the ink cartridge 40 in the inkjet printer 1, the user of the inkjet printer 1 places the ink cartridge 40 in the cartridge tray 35 (see FIG. 2) and subsequently inserts the cartridge tray 35 into space C of the casing 1*a* by moving the cartridge tray 35 in the main scanning direction indicated by the white arrow in FIG. 7A. Initially, this action causes the contact 142 of the ink cartridge 40 to make contact with the contact 152 on the inkjet printer 1, as shown in FIG. 7A, providing an electrical connection between the ink cartridge 40 and the inkjet printer 1. Accordingly, the ink cartridge 40 and the inkjet printer 1 can now exchange signals.

At approximately the same time that the contacts 142 and 152 come into contact, the power input unit 147 of the ink cartridge 40 contacts the power output unit 157 of the inkjet printer 1, as shown in FIG. 7A. This contact forms an electrical connection that allows the power supply 158 in the inkjet printer 1 (see FIG. 8) to supply power to the sensor unit 70 and the memory unit 141 via the power output unit 157 and the power input unit 147.

The power input unit 147 is exposed on the outer surface of the case 41 at a position near the contact 142. The power input unit 147 is electrically connected to the sensor unit 70 and the memory unit 141.

At this stage, the ink cartridge 40 remains separated from the hollow needle 153. Therefore, the reservoir 42 is not in communication with the ink channel formed in the corresponding inkjet head 2.

Figure 9:
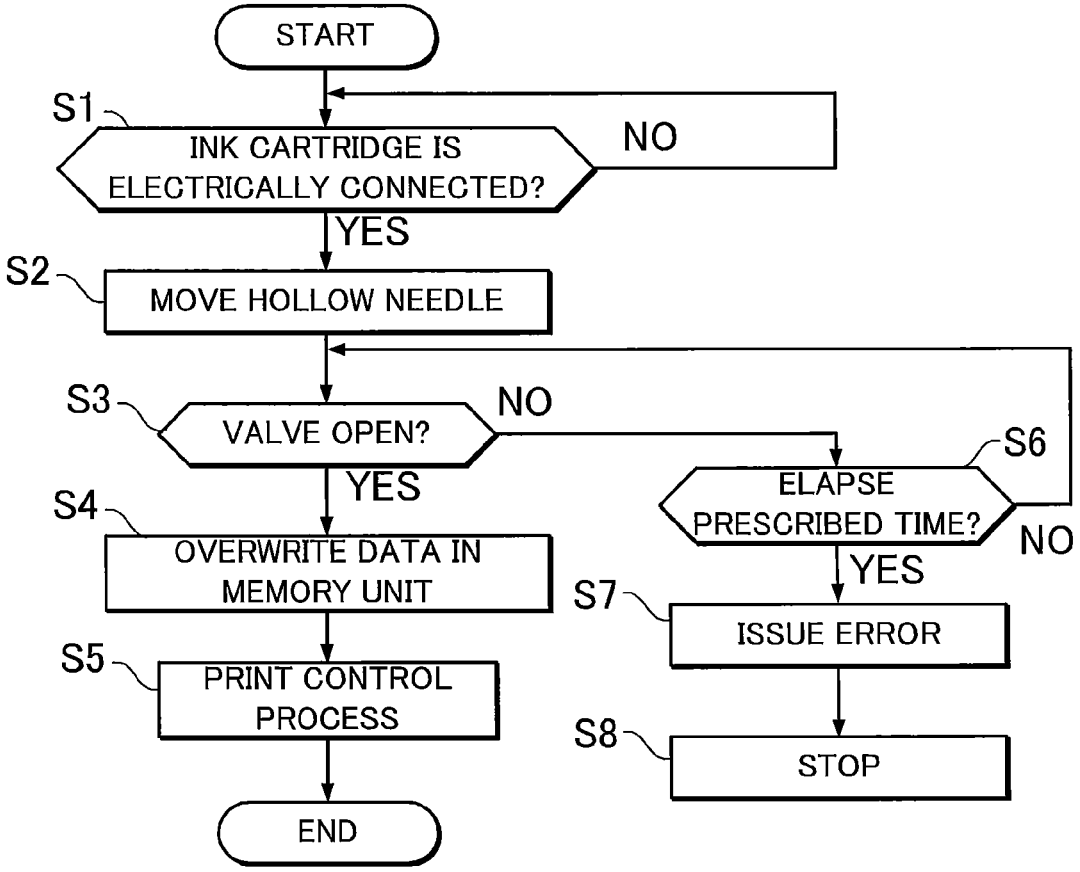
FIG. 9 is a flowchart showing a process executed by a controller in the printer when the ink cartridge is mounted in the printer.

FIG. 9 illustrates steps in a control process performed by the controller 100 when the ink cartridge 40 is mounted in the inkjet printer 1. In S1 of FIG. 9, the controller 100 determines whether an ink cartridge 40 has been electrically connected to the inkjet printer 1. Upon detecting an ink cartridge 40 being electrically connected to the inkjet printer 1 (S1: YES), in S2 the controller 100 controls the moving mechanism 155 (see FIG. 8) to begin moving the support body 154 and the hollow needle 153 supported in the support body 154 in the main scanning direction as indicated by the black arrow in FIG. 7B. After initiating the operation to move the hollow needle 153 in S2, in S3 the controller 100 determines whether the valve 60 has switched to the open position based on the signal outputted from the Hall element 71, and the like.

As the moving mechanism 155 begins moving the hollow needle 153 in S2, the hollow needle 153 first passes through the hole 46*a* formed in the cap 46 and penetrates the approximate center region of the stopper 50 in the main scanning direction, as illustrated in FIG. 6B. Once the hollow needle 153 is inserted far enough that the hole 153*b* formed in the distal end thereof is positioned inside the supply path 43*a*, the channel 153*a* formed in the hollow needle 153 is brought into fluid communication with the supply path 43*a* through the hole 153*b*. Although a penetration hole is formed in the stopper 50 by the hollow needle 153 through this operation, the elasticity of the stopper 50 causes the portion of the stopper 50 around the penetration hole to form a tight seal with the circumferential surface of the hollow needle 153, thereby preventing ink from leaking out through the penetration hole between the stopper 50 and the hollow needle 153.

As the moving mechanism 155 continues to move the hollow needle 153, the distal end of the hollow needle 153 is brought into contact with the valve body 62 and continues inward into the supply path 43*a*, pushing the valve body 62 also inward into the supply path 43*a*. The O-ring 61 moves together with the valve body 62 and separates from the valve seat 43*z* (see FIGS. 6B and 6D). At this time, the valve 60 shifts from the closed position to the open position.

When the valve 60 is in the open position, the supply path 43*a* allows external communication with the reservoir 42. In other words, when the hollow needle 153 is inserted through the stopper 50 until the valve 60 is in the open position shown in FIGS. 6B and 6D, the reservoir 42 is in fluid communication with the ink channel formed in the inkjet head 2 through the supply path 43*a*, the channel 153*a*, and the like.

Figure 10:
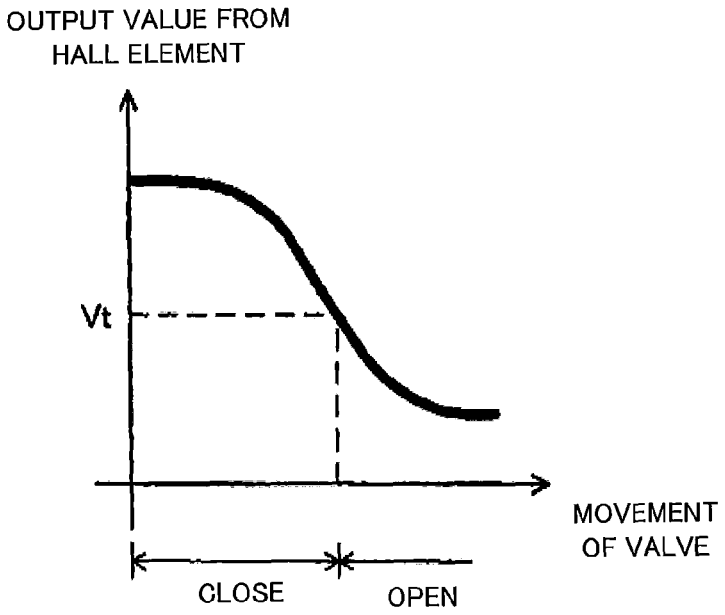
FIG. 10 is a graph showing a relationship between a movement of the valve and an output value of a hall element.

The graph in FIG. 10 shows the relationship between movement of the valve 60 and the output value from the Hall element 71. The horizontal axis in the graph denotes the movement distance of valve 60 over which the valve body 62 has moved away from the stopper 50 in the main scanning direction from the closed position shown in FIGS. 6A and 6C. When the output value from the Hall element 71 reaches a threshold value Vt, the controller 100 determines that the valve 60 is shifted from the closed position to the open position.

While the controller 100 determines in S3 that the valve 60 has not moved to the open position (S3: NO), the controller 100 continually repeats the determination in S3 while also determining in S6 whether a prescribed time has elapsed (S6).

When the controller 100 determines in S3 that the valve 60 has moved to the open position (S3: YES), in S4 the controller 100 overwrites data stored in the memory unit 141 for a variable. Specifically, the controller 100 increments a variable n by 1, where the variable n indicates the number of times that the hollow needle 153 has been inserted through the stopper 50.

In S5 the controller 100 initiates a print control process and subsequently ends the current routine. In the print control process of S5, the controller 100 performs processes required when print commands are received from external devices, such as driving the feeding motor 125, the conveying motor 127, and the feeding motor 128 (see FIG. 8), as well as driving the inkjet heads 2 and the like.

However, if the prescribed time elapses before the valve 60 moves to the open position (S6: YES), in S7 the controller 100 issues an error notification to the user by displaying an image on a display of the inkjet printer 1, outputting sounds through speakers, or the like. In S8 the controller 100 halts operations of the components in the inkjet printer 1 under the assumption that an error may have occurred due to a malfunction of the sensor unit 70, the stopper 50, or the valve 60 in the ink cartridge 40 or a malfunction of the hollow needle 153 or the moving mechanism 155 of the printer 1, or the like.

When a plurality of the ink cartridges 40 is mounted in the printer 1 simultaneously, the controller 100 performs the same series of processes as described in FIG. 9 for each ink cartridge 40.

To remove an ink cartridge 40 from the printer 1, the user of the inkjet printer 1 first removes the cartridge tray 35 from the casing 1*a*. Through this operation, all four ink cartridges 40 are simultaneously separated from their respective support bodies 154, the contacts 152, and the power output units 157. Then, the electrical connections is interrupted between the respective contacts 142 and the contacts 152 and between the respective power input units 147 and the power output units 157, disabling the ability of each ink cartridge 40 to exchange signals with the inkjet printer 1, and blocking the supply of power to the sensor unit 70 and the memory unit 141 in each ink cartridge 40. In addition, as the feed tube 43 moves rightward in FIG. 6B at this time, the urging force of the coil spring 63 moves the valve 60 leftward in FIG. 6B as the hollow needle 153 is extracted from the supply path 43*a* until the valve 60 is in contact with the valve seat 43*z*. At this time, the valve 60 switches from the open position to the closed position. After the hollow needle 153 is extracted from the stopper 50, the portion of the stopper 50 surrounding the penetration hole formed by the hollow needle 153 elastically returns to its original state, reducing the size of the penetration hole by a degree sufficient to suppress ink leakage.

Once the controller 100 detects that the ink cartridge 40 is no longer electrically connected to the printer 1 as the ink cartridge 40 is being removed, the controller 100 controls the moving mechanism 155 to move the hollow needle 153 from its insertion position (see FIG. 7B) to its non-insertion position (see FIG. 7A).

Next, a method of manufacturing a new ink cartridge 40 according to the preferred embodiment will be described with reference to FIG. 11. The steps in the manufacturing method may be performed by manufacturing equipment and/or a user. In the preferred embodiment, manufacturing equipment is used to perform all steps. The manufacturing equipment includes an injector 500 (see FIG. 15), a parts assembly unit, a controller, and a display. The injector 500 includes an injection needle 510 movable vertically.

Figure 11:
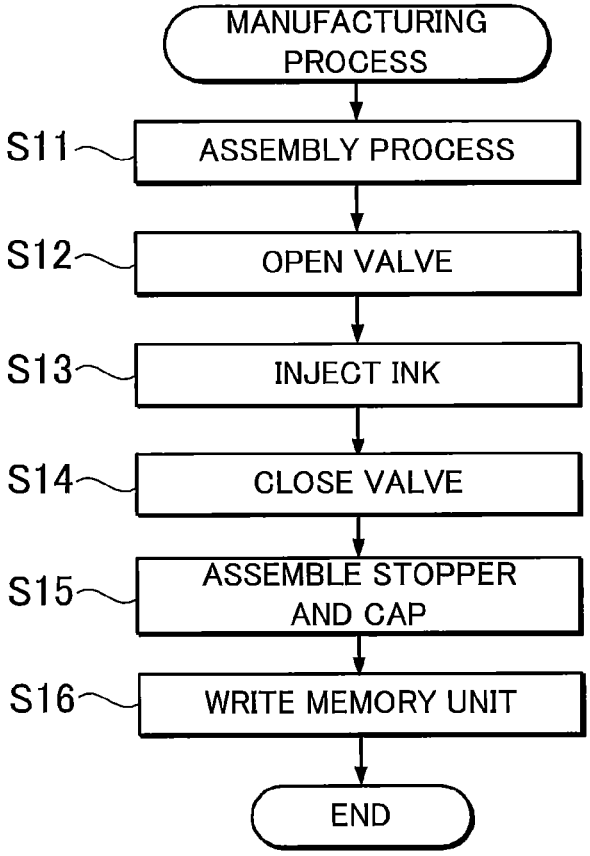
FIG. 11 is a flowchart showing a manufacturing process of the ink cartridge.

At the beginning of the manufacturing process in S11 of FIG. 11, the controller of the manufacturing equipment drives the parts assembly unit to assemble all components constituting the ink cartridge 40 (including the case 41, the reservoir 42, the feed tube 43, the valve 60, the sensor unit 70, the memory unit 141, and the contact 142), excluding the stopper 50 and the cap 46. FIG. 15B1 shows the state of the ink cartridge 40 assembled through the process of S11.

Figure 2:
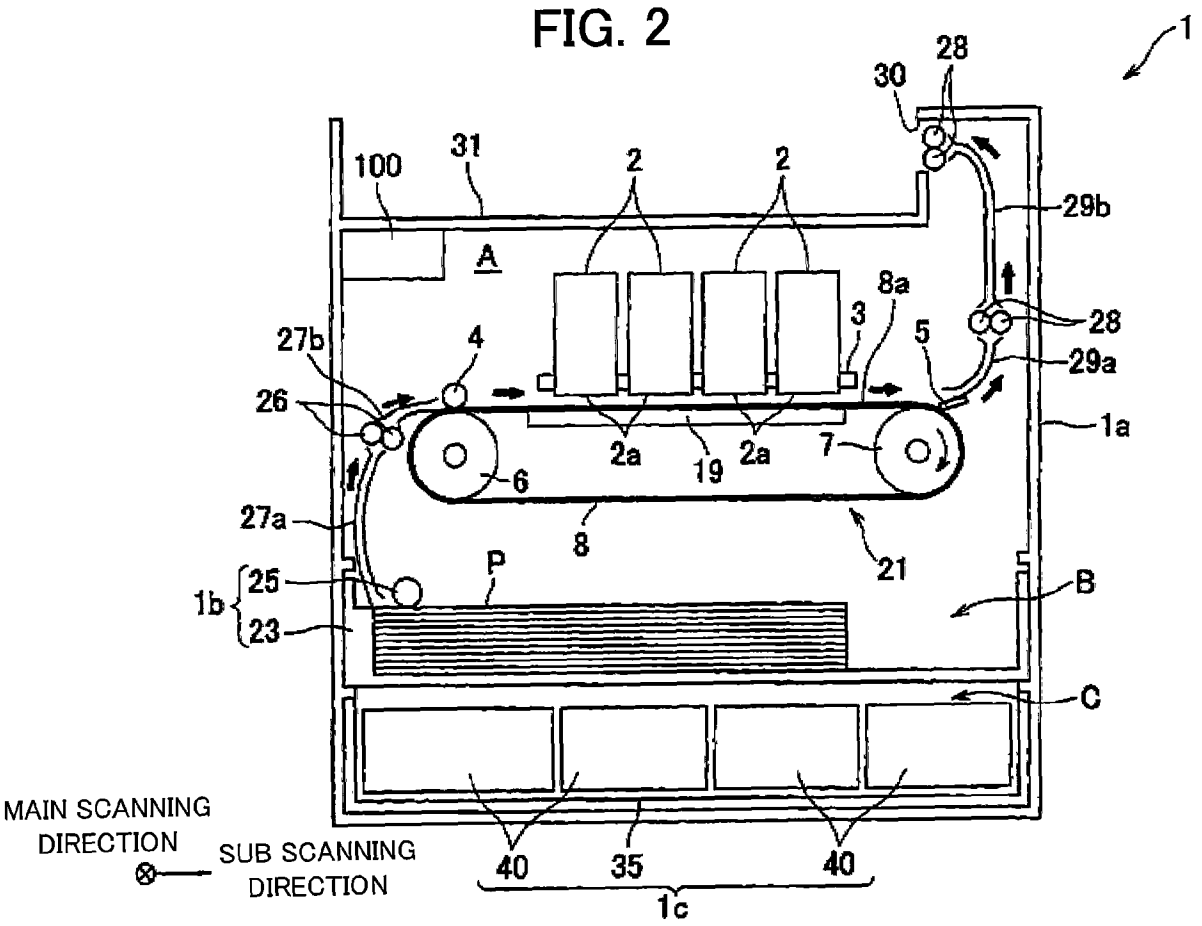
FIG. 2 is a schematic side view of an internal structure of the printer.

After completing the assembly process in S11, in S12 the controller drives the injector 500 to insert the injection needle 510 into the supply path 43*a* through the opening 43*b*, as illustrated in FIG. 15B2. The injection needle 510 contacts and begins pressing the valve body 62 inward against the urging force of the coil spring 63 until the valve 60 moves from the closed position to the open position.

As with the hollow needle 153 described above, the injection needle 510 is formed with a channel 510*a* inside the injection needle 510 extending in a longitudinal dimension thereof, and a hole 510*b* near the distal end of the injection needle 510. In addition to the injection needle 510, the injector 500 includes a support body 501 for supporting the injection needle 510, an ink tank (not shown) holding ink, a suction pump for suctioning ink from the reservoir 42, and an injection pump (not shown) for feeding ink from the ink tank through the channel 510*a* toward the hole 510*b*.

While the stopper 50 remains unmounted in the opening 43*b*, as shown in FIG. 15B2, in S13 the controller drives the injection pump to inject ink into the reservoir 42 through the injection needle 510 while maintaining the valve 60 in the open position. At this time, ink travels from the ink tank to the supply path 43*a* via the channel 510*a* and hole 510*b* and is injected into the reservoir 42 through the supply path 43*a*. During the injection operation, the support body 501 seals the opening 43*b* and holds the injection needle 510 such that the hole 510*b* is disposed at a position in the supply path 43*a* closer to the reservoir 42 than the valve seat 43*z*.

After the reservoir 42 has been filled in S13, in S14 the controller drives the injector 500 to move the injection needle 510 upward, thereby separating the injection needle 510 from the valve 60 and causing the valve 60 to return to the closed position. That is, as the injection needle 510 is retracted from the supply path 43*a*, the urging force of the coil spring 63 moves the valve 60 from the open position to the closed position. Subsequently, the injection needle 510 is extracted completely from the supply path 43*a*. Note that steps S13 and S14 are performed while the ink cartridge 40 is oriented with the opening 43*b* at the top in order to prevent ink from leaking out through the opening 43*b*.

In S15 the controller of the manufacturing equipment drives the parts assembly unit to assemble the stopper 50 and the cap 46 in the opening 43*b* while the valve 60 is maintained in the closed position. At this point, the opening 43*b* is closed by the stopper 50, and the stopper 50 is in a compressed state inside the opening 43*b*.

In S16 the controller of the manufacturing equipment writes data to the memory unit 141. Specifically, the controller writes a "0" in the memory unit 141 as the variable n indicating the number of times that the hollow needle 153 has been inserted through the stopper 50. The controller also writes data in the memory unit 141 indicating the manufacturing date of the stopper 50. This completes the process for manufacturing a new ink cartridge 40.

Next, a method of recycling an ink cartridge 40 will be described with reference to FIGS. 12-14. Each step of the recycling method described below may be performed with recycling equipment and/or a user. In the preferred embodiment, recycling equipment is used to perform all steps of the recycling process. The recycling equipment includes the injector 500 (see FIG. 15), a parts removal and replacement unit, a controller, and a display.

Figure 12:
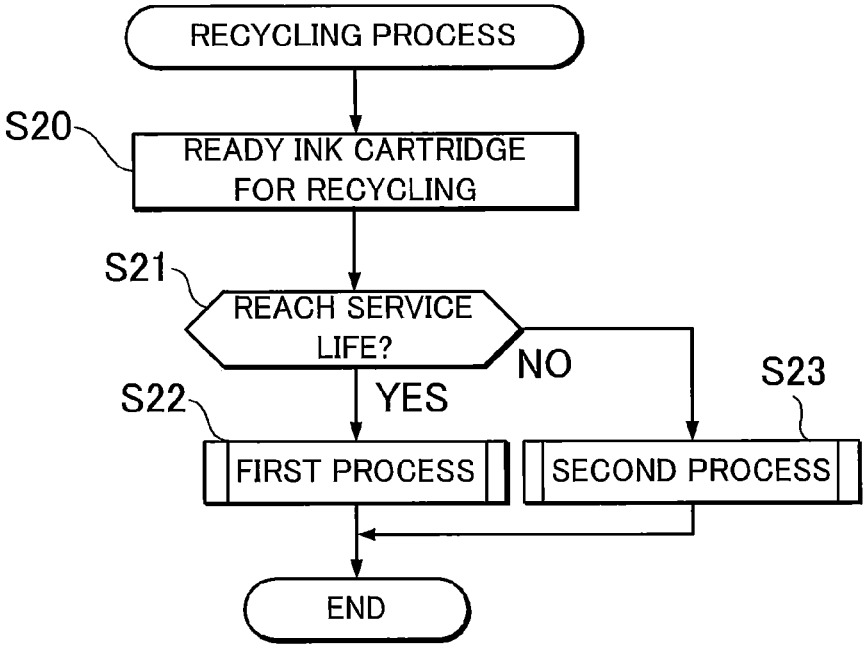
FIG. 12 is a flowchart showing a recycling process of the ink cartridge.

In S20 at the beginning of the recycling process in FIG. 12, the controller readies an ink cartridge 40 for recycling. Here, the ink cartridge 40 for recycling is not limited whether the ink cartridge 40 is a used item having a penetration hole formed in its stopper 50 by the hollow needle 153 or the like, or whether a certain amount of time has elapsed after the ink cartridge 40 was manufactured.

In S21 the controller reads data from the memory unit 141 in the ink cartridge 40 prepared in S20 and determines whether the stopper 50 of the ink cartridge 40 has reached the end of its service life. In this process, the controller determines whether the variable n indicating the number of times that the hollow needle 153 was inserted through the stopper 50 has reached a prescribed number indicating the end of its service life. The controller also calculates the amount of time that has elapsed after the stopper 50 was manufactured (the time elapsed from the date that the stopper 50 was manufactured to the current date) based on data stored in the memory unit 141 related to the manufacturing date of the stopper 50 and determines whether the elapsed time exceeds a prescribed time indicating the end of its service life. The controller determines that the stopper 50 has reached the end of its service life (S21: YES) if the variable n exceeds the prescribed number for the end of service life or if the elapsed time exceeds the prescribed amount of elapsed time for the end of service life. If neither case is true, the controller determines that the stopper 50 has not reached the end of its service life (S21: NO).

The controller performs a first process in S22 when determining that the stopper 50 has reached the end of its service life (S21: YES) and performs a second process in S23 when determining that the stopper 50 has not reached the end of its service life (S21: NO).

Figure 13:
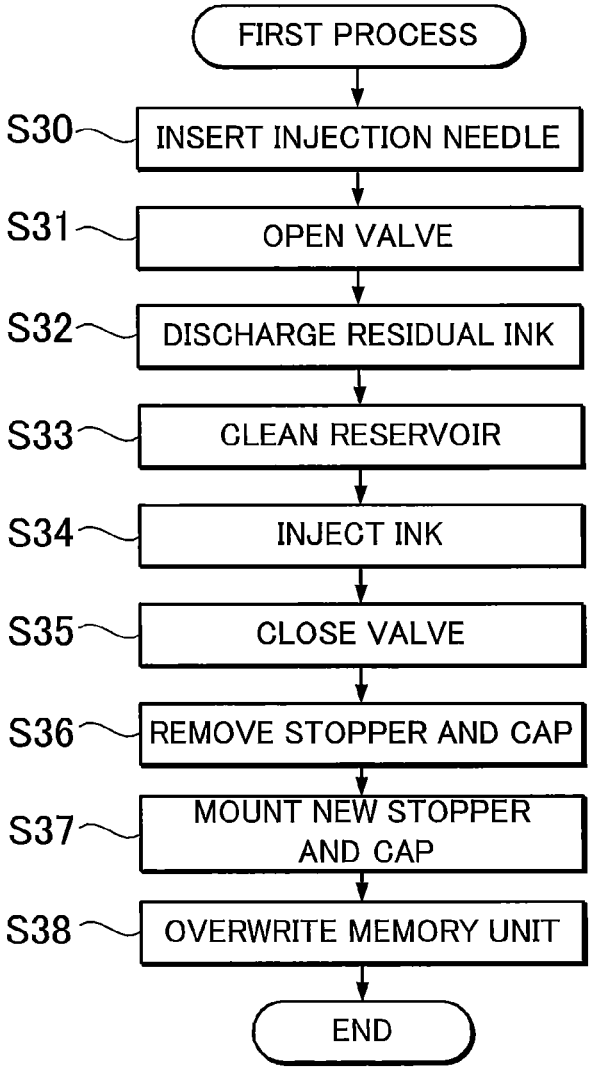
FIG. 13 is a flowchart showing a first process of the recycling process.

FIG. 13 shows the steps in the first process of S22. First, the controller prepares the ink cartridge 40 with the original stopper 50 and the cap 46 still mounted over the opening 43*b*, as shown in FIG. 15A1. In S30 of FIG. 13, the controller drives the injector 500 to insert the injection needle 510 through the stopper 50 mounted in the opening 43*b*, as shown in FIG. 15A2. In S31 the controller drives the injector 500 to continue inserting the injection needle 510 such that the injection needle 510 contacts and presses the valve body 62 inward against the urging force of the coil spring 63, moving the valve 60 from the closed position to the open position. In S32 the controller performs a discharge step to discharge any residual ink from the reservoir 42 while maintaining the valve 60 in the open position. In the discharge step, the controller drives the suction pump to generate suction in the injection needle 510, thereby drawing ink from the reservoir 42 into the hole 510*b* and discharging this ink into a waste ink tank. In S33 the controller performs a cleaning step to clean the inside of the reservoir 42 while still maintaining the valve 60 in its open position. In the cleaning step, the controller injects a cleaning solution into the reservoir 42 through the injection needle 510 while maintaining the valve 60 in the open position and oscillates the reservoir 42 with ultrasound waves in order to clean the reservoir 42. Subsequently, the controller drives the suction pump to extract the cleaning solution from the reservoir 42 through the hole 510*b* of the injection needle 510 and discharges the extracted cleaning solution into the waste ink tank.

In S34 the controller drives the injection pump to inject ink into the reservoir 42 through the injection needle 510 while maintaining the valve 60 in the open position, as illustrated in FIG. 15A2. In this process, ink is supplied from an ink tank to the supply path 43*a* via the channel 510*a* and the hole 510*b* and is injected into the reservoir 42 through the supply path 43*a*. During this operation, the opening 43*b* remains sealed by the stopper 50, and the injector 500 holds the injection needle 510 such that the hole 510*b* is positioned within the supply path 43*a* closer to the reservoir 42 than the valve seat 43*z*.

Once the reservoir 42 has been filled with ink in S34, in S35 the controller drives the injector 500 to move the injection needle 510 upward, separating the injection needle 510 from the valve 60 so that the valve 60 returns to the closed position. Here, the urging force of the coil spring 63 moves the valve 60 from the open position to the closed position as the injection needle 510 retracted from the supply path 43*a*. Note that the processes in S34 and S35 are performed while the ink cartridge 40 is oriented with the opening 43*b* at the top in order to prevent ink from leaking out of the opening 43*b*.

In S36 the controller drives the parts assembly unit to remove the stopper 50 and the cap 46 from the opening 43*b* while maintaining the valve 60 in the closed position. In S37 the controller drives the parts assembly unit to mount a new stopper 50 in the opening 43*b* and to mount a new cap 46 over the stopper 50. At this time, the stopper 50 seals the opening 43*b* and is in a compressed state within the opening 43*b*.

In S38 the controller overwrites the data in the memory unit 141 to set the variable n indicating the number of times that the hollow needle 153 has been inserted through the stopper 50 to "0" (n→0) and subsequently ends the current routine.

Figure 14:
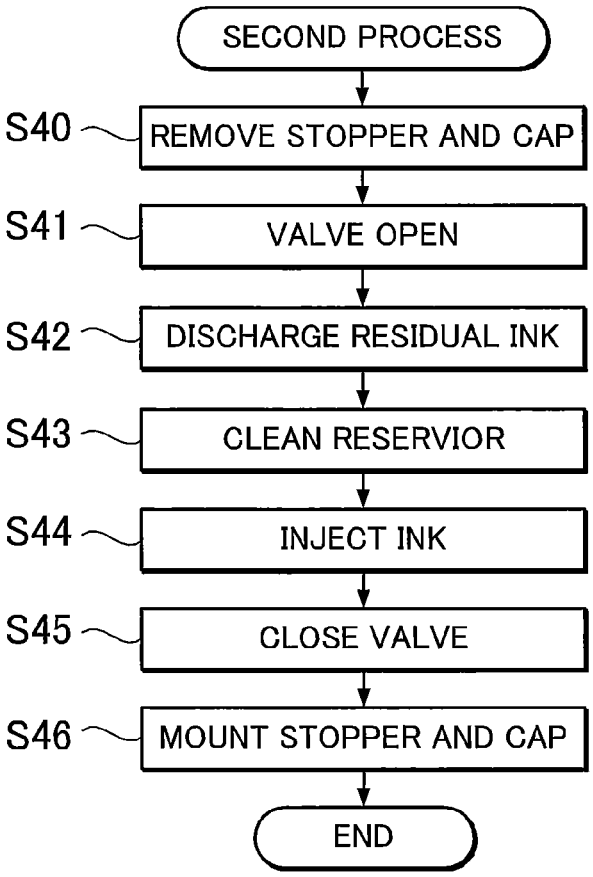
FIG. 14 is a flowchart showing a second process of the recycling process.

FIG. 14 shows steps in the second process of S23. First, in S40 the controller of the recycling equipment drives the parts assembly unit to remove the stopper 50 and the cap 46 from the ink cartridge 40. This operation results in the ink cartridge 40 without the stopper 50 and the cap 46, as illustrated in FIG. 15B1.

In S41 the controller drives the injector 500 to insert the injection needle 510 into the supply path 43*a* through the opening 43*b*, as shown in FIG. 15B2. The controller continues driving the injector 500 so that the injection needle 510 contacts and pushes the valve body 62 inward against the urging force of the coil spring 63, moving the valve 60 from the closed position to the open position.

In S42 the controller performs the discharge step described in S32 of the first process to discharge residual ink from the reservoir 42 while maintaining the valve 60 in the open position. In S43 the controller performs the cleaning step described in S33 of the first process for cleaning the inside of the reservoir 42 while maintaining the valve 60 in the open position. Note that the controller performs steps S42 and S43 even when the variable n is found to be "0" in S21 of FIG. 12.

In S44 the controller drives the injection pump to inject ink into the reservoir 42 through the injection needle 510 while maintaining the valve 60 in the open position, as illustrated in FIG. 15B2. In this process, ink is supplied from an ink tank into the supply path 43*a* via the channel 510*a* and the hole 510*b* and is injected into the reservoir 42 through the supply path 43*a*. During this operation, the support body 501 seals the opening 43*b* and holds the injection needle 510 so that the hole 510*b* is disposed inside the supply path 43*a* in a position closer to the reservoir 42 than the valve seat 43*z*.

In S45 the controller drives the injector 500 to raise the injection needle 510 and separate the injection needle 510 from the valve 60 so that the valve 60 returns to the closed position. Here, the urging force of the coil spring 63 moves the valve 60 from the open position to the closed position as the injection needle 510 is retracted from the supply path 43*a*. The injection needle 510 is subsequently removed entirely from the supply path 43*a*. Note that steps S44 and S45 are performed while the ink cartridge 40 is oriented with the opening 43*b* at the top in order to prevent ink from leaking out of the opening 43*b*.

In S46 the controller drives the parts assembly unit to mount the stopper 50 and the cap 46 that were removed in S40 over the opening 43*b* while maintaining the valve 60 in the closed position. At this point, the stopper 50 seals the opening 43*b* and is in a compressed state within the opening 43*b*. After completing the process in S46, the current routine ends.

Completing either the first process of S22 or the second process of S23 produces a recycled ink cartridge 40. When any ink cartridge 40 is mounted in the printer 1, the controller 100 performs the control process shown in FIG. 9, regardless of whether the ink cartridge 40 is a recycled product or a non-recycled product (a new product).

The method of recycling an ink cartridge 40 according to the preferred embodiment described above can suppress ink leakage from the opening 43*b* during the process to inject ink by injecting the ink into the reservoir 42 while the stopper 50 is mounted in the opening 43*b* (S30-S34 of the first process). The recycling method also suppresses ink leakage through the stopper 50 following the ink injection step by replacing the stopper 50 with a new stopper after the current stopper 50 has been pierced by the injection needle 510 (S36 and S37 of the first process). The recycling method of the present invention also suppresses ink leakage while the stopper 50 is being replaced by maintaining the valve 60 in the closed position while replacing the stopper 50 in S36 and S37 of the first process. Thus, the method according to the preferred embodiment effectively suppresses ink leakage using the stopper 50 and the valve 60.

In S31 of the first process, the controller continues to move the injection needle 510 after the injection needle 510 has been inserted through the stopper 50 in S30 until the injection needle 510 contacts the valve 60 and moves the valve 60 from the closed position to the open position. Thus, the process in S31 (valve opening step) is facilitated using the injection needle 510 that was already inserted through the stopper 50 in S30.

When the controller determines in S21 that the stopper 50 has not yet reached the end of its service life (when the variable n indicating the number of times that the hollow needle 153 was inserted into the stopper 50 is small and/or when little time has elapsed since the stopper 50 was manufactured), the controller employs the second process in which ink is injected after removing the stopper 50 from the opening 43*b*, rather the first process in which ink is injected after inserting the injection needle 510 directly through the stopper 50. This method suppresses ink leakage without having to discard the stopper 50. However, when the controller determines in S21 that the stopper 50 has reached the end of its service life (when the variable n indicating the number of times that the hollow needle 153 was inserted into the stopper 50 is large and/or when a lengthy time has elapsed since the stopper 50 was manufactured), the controller employs the first process in which ink is injected by inserting the injection needle 510 directly through the stopper 50. This process can use the stopper 50 to suppress ink leakage from the opening 43*b* during the ink injection step when the stopper 50 has reached the end of its service life.

The controller also stores reference data in the memory unit 141 of the ink cartridge 40 for determining whether the stopper 50 has reached the end of its service life (the number of times that the hollow needle 153 was inserted through the stopper 50 and/or the amount of time elapsed since the stopper 50 was manufactured). Thus, in S21 of FIG. 12 the controller reads this data from the memory unit 141 to determine whether the stopper 50 has reached the end of its service life. In this way, a more exact determination can be performed in S21 by using a computer rather than relying on the user's visual determination.

The reservoir 42 of the ink cartridge 40 being recycled may contain residual ink. When the variable n is "0", in particular, it is likely that the reservoir 42 currently holds its maximum capacity of ink. If the controller were simply to perform the ink injection step without first performing the discharge step and the cleaning step, ink would simply overflow from the opening 43*b*. However, by performing the discharge step (S32, S42), the method according to the preferred embodiment suppresses ink overflow from the reservoir 42. Further, by discharging ink that has likely degraded and refilling the reservoir 42 with new ink, the method according to the preferred embodiment can improve the quality of ink accommodated in the reservoir 42. In addition, by performing the cleaning step (S33, S43) after the discharge step, the method according to the preferred embodiment can remove any traces of ink in the reservoir 42 that were not removed during the discharge step, thereby preventing the newly introduced ink from mixing with older residual ink. Thus, the method of the preferred embodiment can further improve the quality of ink accommodated in the reservoir 42.

In S46 of the second process, the controller remounts the stopper 50 and the cap 46, which were removed in S40, in the opening 43*b*, thereby reusing the stopper 50 and the cap 46 to achieve lower recycling costs.

Next, a liquid cartridge according to a second embodiment will be described with reference to FIGS. 16 through 18. The liquid cartridge according to the second embodiment of the present invention is an ink cartridge 240 shown in FIG. 16. The ink cartridge 240 has a structure identical to the ink cartridge 40 of the first embodiment, except that the cap 46 has been omitted from the ink cartridge 240 and replaced with a conductor 250.

Figure 16A:
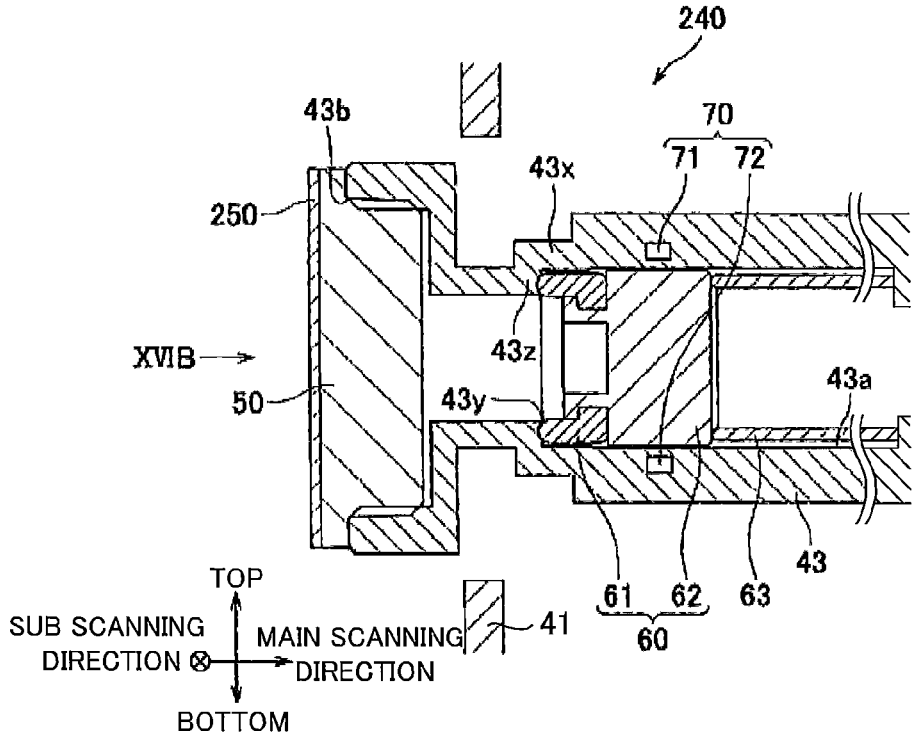
FIG. 16A is a partial cross-sectional view of an ink cartridge according to a second embodiment of the present invention.
Figure 16B:
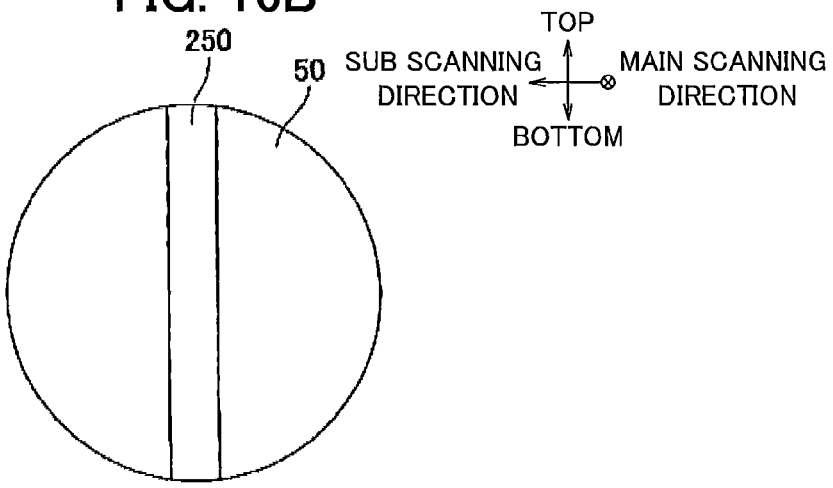
FIG. 16B is a schematic view of a stopper and a conductor as viewed from an arrow XVIB in FIG. 16A.

As shown in FIG. 16A, the conductor 250 is provided on the outer surface of the stopper 50 (the surface on the opposite side of the inner surface that opposes the valve 60). As shown in FIG. 16B, the conductor 250 has a narrow rectangular strip-like shape and extends vertically through the center of the stopper 50 on the outer surface thereof.

Figure 17A:
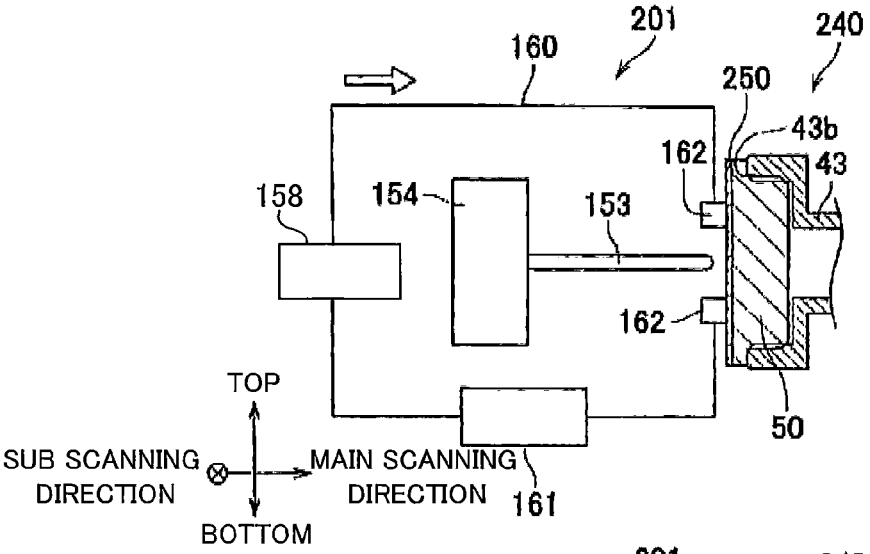
FIG. 17A is a partial schematic view showing a state before mounting the ink cartridge in a printer.
Figure 17B:
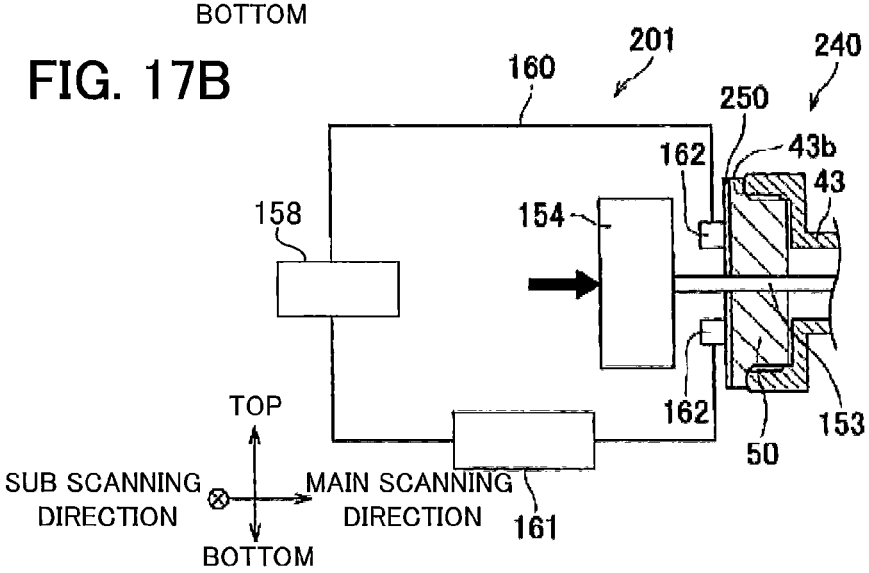
FIG. 17B is a partial schematic view showing a state after mounting the ink cartridge in the printer.

FIG. 17 shows a printer 201 in which the ink cartridge 240 of the second embodiment is detachably mounted. The printer 201 is similar to the printer 1 of the first embodiment but includes a circuit 160 shown in FIG. 17A. One circuit 160 is provided for each ink cartridge 240 and includes a power supply 158, an ammeter 161, and a pair of contacts 162. Each pair of contacts 162 is disposed inside the main casing 1*a* at positions confronting the conductor 250 of the corresponding ink cartridge 240, such that the contacts 162 in each pair are vertically separated from each other.

Next, steps in a process for mounting an ink cartridge 240 in the printer 201 will be described. As described above in the first embodiment, electrical connections are established between the contact 142 and the contact 152 and between the power input unit 147 and the power output unit 157 when the ink cartridge 240 is initially mounted in the printer 201, as shown in FIG. 7A. At this time, the controller 100 of the printer 201 detects the electrical connection between the ink cartridge 240 and the printer 201 (S51 of FIG. 18: YES).

Thus, in S52 the controller 100 begins moving the contacts 162 in the main scanning direction, as indicated by the white arrows in FIG. 17A. After initiating movement of the contacts 162 in S52, in S53 the controller 100 determines whether the circuit 160 has been formed based on the electric current value acquired from the ammeter 161. As shown in FIG. 17A, the circuit 160 is formed when the contacts 162 contact the conductor 250 and establish an electrical connection with each other via the conductor 250.

Figure 17C:
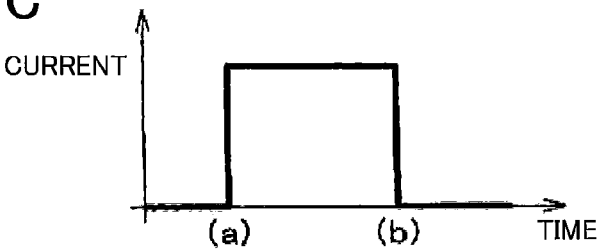
FIG. 17C is a graph showing a detecting result of an ammeter in the printer.
Figure 18:
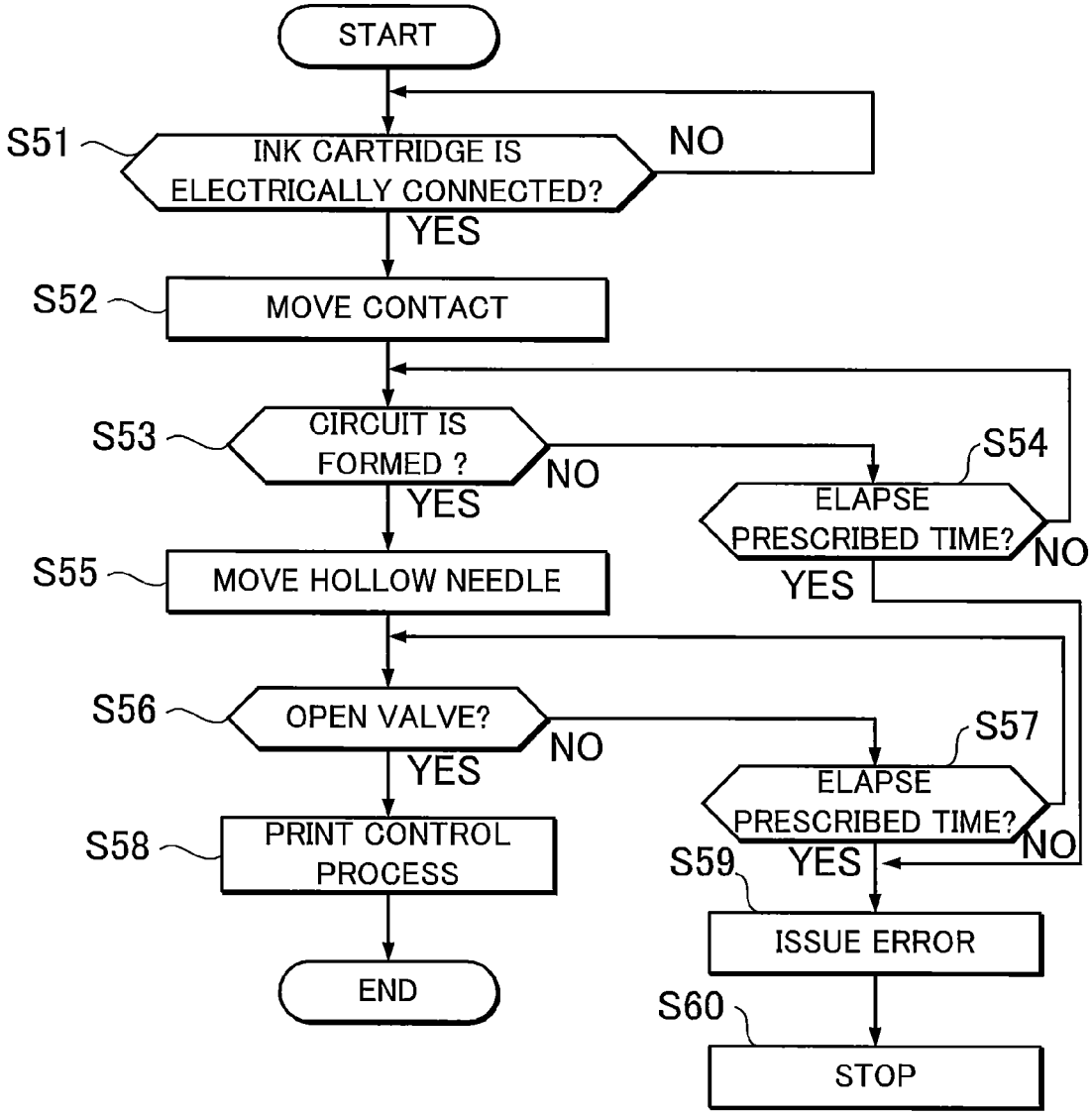
FIG. 18 is a flowchart showing a process executed by a controller in the printer when the ink cartridge is mounted in the printer.

During this operation, the current value measured by the ammeter 161 fluctuates, as shown in the graph of FIG. 17C. In this graph, (a) indicates the electric current measured when the printer 201 and the ink cartridge 240 are in the state shown in FIG. 17A, while (b) indicates the electric current measured when the hollow needle 153 ruptures the conductor 250 as described later. The controller 100 determines in S53 that the circuit 160 has been formed, as shown in FIG. 17A, when the value of the electric current rises.

If the controller 100 determines in S53 that the circuit 160 has not been formed (S53: NO), the controller 100 continually repeats this determination in S53 while also determining in S54 whether a prescribed time has elapsed. If the prescribed time elapses before the circuit 160 is formed (S54: YES), in S59 the controller 100 issues an error notification and in S60 halts operations of the printer 201 components, as described in S7 and S8 of the first embodiment.

Once the circuit 160 has been formed (S53: YES), in S55 the controller 100 controls the moving mechanism 155 to begin moving the support body 154 together with the hollow needle 153 in the main scanning direction indicated by the black arrow in FIG. 17B. After initiating the operation to move the hollow needle 153 in S55, in S56 the controller 100 determines whether the valve 60 has switched to the open position, based on the value outputted from the Hall element 71 and the like, as described in S3 of the first embodiment.

As shown in FIG. 17A, the hollow needle 153 in the second embodiment is disposed at a position farther separated from the ink cartridge 240 than the contacts 162 are separated from the ink cartridge 240 until the controller 100 begins moving the hollow needle 153 in S55. As the moving mechanism 155 begins moving the hollow needle 153 in S55, the hollow needle 153 begins to protrude farther toward the ink cartridge 240 than the contacts 162 and is inserted through the conductor 250 into the stopper 50, as shown in FIG. 17B. During this movement, the hollow needle 153 ruptures the conductor 250, breaking the conductor 250 into two pieces. Since the pieces of the ruptured conductor 250 are disposed on opposing sides of the hollow needle 153 and the hollow needle 153 is formed of an insulating material, the current value measured by the ammeter 161 returns to "0", as shown in FIG. 17C.

Once the controller 100 determines that the valve 60 has shifted to the open position (S56: YES), in S58 the controller 100 begins the same print control process described in S5 of the first embodiment, and subsequently ends the current routine. However, if the prescribed time elapses before the valve 60 shifts into its open position (S57: YES), in S59 the controller 100 issues an error notification and in S60 halts operations of the printer 201 components, as described in the first embodiment.

Next, a method of manufacturing the ink cartridge 240 according to the second embodiment will be described. The manufacturing method according to the second embodiment is identical to that described in the first embodiment, except that step S16 of FIG. 11 can be omitted.

Next, the method of recycling an ink cartridge 240 according to the second embodiment will be described. The recycling method according to the second embodiment differs from the first embodiment in that the controller determines whether the stopper 50 has reached the end of its service life (S21 of FIG. 12) based on the state of the conductor 250 rather than data read from the memory unit 141, and by the omission of step S38 in the first process (see FIG. 13). Below, the differences from the first embodiment will be described.

In S21 the controller of the recycling equipment determines whether the stopper 50 has reached the end of its service life based on the existence of a circuit formed through the conductor 250. This determination is made using elements similar to the circuit 160 of the printer, for example (see FIG. 17A). Since the conductor 250 would be ruptured if the hollow needle 153 has formed an insertion hole in the stopper 50, the measured electric current would not rise when the pair of contacts 162 was placed in contact with the conductor 250, as shown FIG. 17A. In this case, the controller determines that the stopper 50 has reached the end of its service life (S21: YES) and performs the first process of S22. However, if the hollow needle 153 has not formed a penetration hole in the stopper 50, the measured current would rise as shown in FIG. 17C when the contacts 162 contacted the conductor 250, as shown in FIG. 17A. In this case, the controller determines that the stopper 50 has not reached the end of its service life (S21: NO) and performs the second process in S23.

As with the first embodiment described above, the method of recycling the ink cartridge 240 according to the second embodiment can effectively suppress ink leakage using the stopper 50 and the valve 60.

In the second embodiment, the controller determines in S21 whether the stopper 50 has reached the end of its service life based on the state of the conductor 250. Thus, a simple procedure can be employed to determine whether the stopper 50 has reached the end of its service life.

While the invention has been described in detail with reference to specific embodiments thereof, it would be apparent to those skilled in the art that many modifications and variations may be made therein without departing from the scope of the invention, which is defined by the attached claims.

Components of the Ink Cartridge

The sensor for detecting the valve body is not limited to the magnetic sensor described in the embodiments, but may be another type of sensor, such as a reflective-type photosensor, a transmissive-type photosensor, or a sensor with a mechanical switch for detecting the presence of an object through contact. Alternatively, the sensor may be omitted.

The valve body is not limited to a member formed of a magnetic material, but may formed of another material, depending on the type of sensor and the like. For example, the valve body may be formed of a material other than magnetic material when the sensor is a reflective-type photosensor. In this case, a mirror surface for reflecting light may be provided around the peripheral surface of the valve body.

The Hall element 71 and the magnet 72 of the sensor unit 70 need not be provided on the inner surfaces of the respective upper and lower walls constituting the feed tube 43, provided that the Hall element 71 can detect the magnetic field generated by the magnet 72 and the valve body 62. For example, the Hall element 71 and the magnet 72 may be fixed to the outer surfaces of the top and bottom walls.

The configurations of the valve 60 and the valve seat 43*z* are arbitrary and not limited to those described in the embodiments, provided that the valve 60 can open and close the supply path 43*a* by moving therein.

The conductor 250 described in the second embodiment may also be provided on the inner surface of the stopper 50 (the surface opposing the valve 60).

The components of the cartridge according to the present invention may be modified in various ways while keeping within the scope of the claims. For example, it is possible to suitably modify the configuration (shape, position, and the like) of the case 41, the reservoir 42, the feed tube 43, the stopper 50, the valve 60, the sensor unit 70, the memory unit 141, and the like. It is also possible to add new components and to eliminate some of the components described in the embodiments.

Data Stored in Memory Unit of the Ink Cartridge

The memory unit of the cartridge may store both or only one of (1) data related to the number of times that the hollow needle 153 was inserted through the stopper 50 and (2) data related to the time elapsed since the stopper 50 was manufactured. Alternatively, the memory unit 141 may store other reference data for determining whether the stopper 50 has reached the end of its service life.

The data related to the number of times that the hollow needle 153 was inserted through the stopper 50 and the data related to the time elapsed since the stopper 50 was manufactured are not limited to a number and time, respectively, but may be data from which the number and time can be derived.

Data related to the time elapsed since the stopper 50 was manufactured is not limited to data indicating the date that the stopper 50 was manufactured (the manufactured date and time, for example), but may be data indicating the difference in time from the manufactured date to the current date (a value expressed in units of days, years, or the like).

The data related to the number of times that the hollow needle 153 was inserted through the stopper 50 may be stored as a flag indicating whether the hollow needle 153 was inserted through the stopper 50 (for example, the flag is set to OFF when the hollow needle 153 has been inserted through the stopper 50).

The number of times that the hollow needle 153 has been inserted through the stopper 50 may be expressed by the number of actual insertions or the number of inferred insertions.

The memory unit 141 need not store reference data for determining whether the stopper 50 has reached the end of its service life, including data related to the number of times that the hollow needle 153 was inserted through the stopper 50 and data related to the time elapsed since the stopper 50 was manufactured.

Method of Determining Whether Stopper has Reached the End of Service Life

The method of determining whether the stopper 50 has reached the end of its service life may be performed based on one of (1) the number of times that the hollow needle 153 was inserted through the stopper 50 and (2) the time elapsed since the stopper 50 was manufactured. Alternatively, the determination may be made based on other reference data for determining whether the stopper 50 has reached the end of its service life.

The method of determining whether the stopper 50 has reached the end of its service life is not limited to a determination based on data stored in the memory unit 141 of the ink cartridge 40 but may be a visual determination by the user, for example.

Alternatively, the determination step for determining whether the stopper 50 has reached the end of its service life may be omitted, and the first process of FIG. 13 may be performed for all ink cartridges 40 being recycled.

First and Second Processes

The stopper 50 mounted in the opening 43*b* of the supply path 43*a* in S46 of the second process is not limited to the stopper 50 that was removed in S40 of the same process, but may be a new stopper instead. Since the stopper removed in S40 of the second process is still usable, this removed stopper may be used when recycling another liquid cartridge. Further, when a new stopper is mounted in the opening 43*b* in S46 of the second process, it is necessary to update the data stored in the memory unit 141.

The stopper 50 mounted in the opening 43*b* of the supply path 43*a* in S37 of the first process and S46 of the second process may be a stopper that was previously removed in the second process and is still usable. In this case, it is also necessary to update the data stored in the memory unit 141.

The order for executing the insertion step (S30) and valve open step (S31) of the first process is arbitrary. In other words, the insertion step may be performed before, after, or approximately simultaneously with the valve open step. When the insertion step is performed after the valve open step, a member other than the injection needle 510 may be inserted to shift the valve into its open position, for example. In other words, the valve open step may be performed using a member other than the injection needle 510.

One or both of the discharge step (S32, S42) and the cleaning step (S33, S43) may be omitted from the first and second processes.

The discharge and cleaning steps may be performed using the injector 500 or a separate device.

Any of the steps in the method of recycling a liquid cartridge may be performed manually by a user. In this case, the recycling equipment preferably includes a display.

The injection needle 510 and the hollow needle 153 are not limited to members having a sharp needle-like tip, provided that the members can pierce the stopper 50. The ink injection needle 510 need not be capable of piercing the stopper 50 if the injection step (SS34, S44) is performed after the stopper 50 has been removed from the opening 43*b*.

The type of liquid accommodated in the reservoir 42 is not limited to ink, but may be a liquid used to coat the printing medium prior to printing in order to enhance image quality, a cleaning solution for cleaning the conveying belt, or the like.

Mounting Ink Cartridge in Printer

The ink cartridge 40 according to the present invention is not limited to a cartridge mounted in a printer, but may be a cartridge mounted in a facsimile machine, a copy machine, or another printer. Further, the print head of the printer may be a line-type or a serial-type head.

The hollow needle may be inserted through the stopper under control of a controller in the printer, as described in the embodiments, or through a manual operation by the user of the printer. In the latter case, the moving mechanism 155 (see FIG. 8) is omitted from the printer 1 described in the embodiments. When the user mounts the ink cartridge 40 in the printer 1, the hollow needle 153 may be inserted through the stopper 50 at approximately the same time that the electrical connections are formed between the contact 142 and the contact 152 and between the power input unit 147 and the power output unit 157.

The timing at which the ink cartridge 40 and the printer 1 are enabled to exchange signals and the timing at which the printer 1 is capable of supplying power to the ink cartridge 40 may be arbitrarily modified and are not limited to the timings described in the preferred embodiments. In addition, the positions of the contacts 142, 152, the power input units 147, the power output units 157, and the like on the ink cartridges 40 and the printer 1 may be arbitrarily modified.

What is claimed is:

1. A method for manufacturing a liquid container for recycling, the method comprising:

a preparing step for preparing the liquid container for recycling, the liquid container for recycling comprising:

a liquid accommodating portion configured to accommodate therein a liquid;

a flowing path having one end in fluid communication with the liquid accommodating portion and another end formed with an opening;

a closure member configured to be mounted to the opening for covering the opening to close an internal space of the flowing path; and a valve configured to move in the flowing path between an open position to open the flowing path and a closed position to close the flowing path; and a first step comprising:

a valve open step for moving the valve from the closed position to the open position by moving an injection tube inserted in the flowing path in a state that the injection tube is in contact with the valve and the internal space of the flowing path is maintained closed;

an injection step for injecting the liquid into the liquid accommodating portion through the injection tube in a state that the injection tube is maintained inserted in the flowing path, the valve is maintained in the open position, and the internal space of the flowing path is maintained closed, after the valve open step; and a valve close step for moving the valve from the open position to the closed position by moving the injection tube in a direction to retract the injection tube from the flowing path, after the injection step, each of the injection step and the valve close step in the first step being performed in a state that the liquid container for recycling is oriented such that the another end of the flowing path formed with the opening is disposed further upward in a vertical direction relative to the one end of the flowing path that is in fluid communication with the liquid accommodating portion and the another end of the flowing path, at which the opening is formed, faces upwardly in the vertical direction.

2. The method according to claim 1, wherein the liquid container for recycling prepared in the preparing step further comprises:

a valve seat provided in the flowing path at a position that is apart from the closure member and is closer to the liquid accommodating portion than the closure member is to the liquid accommodating portion, the internal space of the flowing path being divided into: a first internal space defined between the one end of the flowing path and the valve seat; and a second internal space defined between the valve seat and the another end of the flowing path, the closure member mounted to the opening being configured to maintain the second internal space out of fluid communication with an outside of the liquid container for recycling; and an urging member configured to urge the valve toward the valve seat, wherein the valve is movable between: the open position where the valve is separated from the valve seat against an urging force of the urging member to bring the first internal space into fluid communication with the second internal space; and the closed position where the valve is in contact with the valve seat by the urging force to bring the first internal space out of fluid communication with the second internal space.

3. The method according to claim 2, wherein during the injection step, an injection hole of the injection tube is disposed in the first internal space of the flowing path.

4. The method according to claim 2, wherein the first step further comprises:

a removal step for removing the closure member from the opening while the valve is maintained in the closed position to maintain the first internal space out of fluid communication with the second internal space after the valve close step; and a mounting step for mounting, to the opening, a new closure member different from the closure member removed at the removal step while the valve is maintained in the closed position to maintain the first internal space out of fluid communication with the second internal space after the removal step.

5. The method according to claim 1, wherein the first step further comprises a discharge step for discharging the liquid accommodated in the liquid accommodating portion, wherein the discharge step is performed after the valve open step and before the injection step.

6. The method according to claim 1, wherein the first step further comprises a cleaning step for cleaning the liquid accommodating portion, wherein the cleaning step is performed after the valve open step and before the injection step.

7. The method according to claim 1, wherein during the valve open step, the injection tube is inserted into the closure member to such an extent that an injection hole of the injection tube is disposed in the internal space of the flowing path at a position between the closure member and the liquid accommodating portion, a tight seal being formed between a circumferential surface of a part of the injection tube that is inserted in the closure member and a part of the closure member that surrounds the injection tube, and wherein the tight seal is maintained during the injection step.

8. A method for manufacturing a liquid container, the method comprising:

a preparing step for preparing a partially completed liquid container that is not yet mounted with a closure member, the partially completed liquid container comprising:

a liquid accommodating portion configured to accommodate therein a liquid;

a flowing path having one end in fluid communication with the liquid accommodating portion and another end formed with an opening and not yet mounted with the closure member; and a valve configured to move in the flowing path between an open position to open the flowing path and a closed position to close the flowing path;

a valve open step for moving the valve from the closed position to the open position by moving an injection tube inserted in the flowing path in a state that the injection tube is in contact with the valve;

an injection step for injecting the liquid into the liquid accommodating portion through the injection tube in a state that the injection tube is maintained inserted in the flowing path, the valve is maintained in the open position, and an internal space of the flowing path is closed, after the valve open step;

a valve close step for moving the valve from the open position to the closed position by moving the injection tube in a direction to retract the injection tube from the flowing path, after the injection step;

wherein during the injection step, a seal is formed between the opening of the flowing path and an injection device that supports the injection tube;

wherein the partially completed liquid container prepared in the preparing step further comprises:

a valve seat provided in the flowing path at a position between the one end and the another end of the flowing path; and an urging member configured to urge the valve toward the valve seat, wherein the valve is movable between the open position where the valve is separated from the valve seat against an urging force of the urging member and the closed position where the valve is in contact with the valve seat by the urging force, and wherein during the injection step, an injection hole of the injection tube is disposed in the flowing path at a position closer to the liquid accommodating portion than the valve seat is to the liquid accommodating portion.

* * * * *